US006755709B2

(12) United States Patent
Jindai et al.

(10) Patent No.: US 6,755,709 B2
(45) Date of Patent: Jun. 29, 2004

(54) METHOD OF FABRICATING ELECTRON-EMITTING DEVICE, ELECTRON SOURCE AND IMAGE-FORMING APPARATUS USING THE ELECTRON SOURCE

(75) Inventors: Kazuhiro Jindai, Kanagawa (JP); Mineto Yagyu, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 34 days.

(21) Appl. No.: 10/152,828

(22) Filed: May 23, 2002

(65) Prior Publication Data

US 2002/0197927 A1 Dec. 26, 2002

(30) Foreign Application Priority Data

May 25, 2001 (JP) ..... 2001/156732
May 16, 2002 (JP) ..... 2002/140959

(51) Int. Cl.[7] ..... H01J 9/02
(52) U.S. Cl. ..... 445/6; 445/24
(58) Field of Search ..... 445/6, 24

(56) References Cited

U.S. PATENT DOCUMENTS

| | | | | |
|---|---|---|---|---|
| 5,066,883 | A | 11/1991 | Yoshioka et al. | 313/309 |
| 5,754,427 | A | 5/1998 | Akagiri | 364/400.01 |
| 6,169,356 | B1 | 1/2001 | Ohnishi et al. | 313/495 |
| 6,179,678 | B1 * | 1/2001 | Kishi et al. | 445/24 |
| 6,336,836 | B1 | 1/2002 | Suzuki et al. | 445/6 |
| 6,344,711 | B1 | 2/2002 | Ohnishi et al. | 313/495 |
| 6,419,539 | B1 * | 7/2002 | Tamura et al. | 445/6 |
| 6,582,268 | B1 * | 6/2003 | Jindai et al. | 445/6 |

FOREIGN PATENT DOCUMENTS

| | | |
|---|---|---|
| EP | 0 660 357 A1 | 6/1995 |
| EP | 0 726 591 A1 | 8/1996 |
| JP | 64-31332 | 2/1989 |
| JP | 1-283749 | 11/1989 |
| JP | 2-257552 | 10/1990 |
| JP | 7-192614 | 7/1995 |
| JP | 7-235255 | 9/1995 |
| JP | 8-7749 | 1/1996 |
| JP | 9-6399 | 1/1997 |
| JP | 9-134666 | 5/1997 |
| JP | 10-50206 | 2/1998 |

OTHER PUBLICATIONS

C.A. Spindt, *A Thin–Film Field Emission Cathode*, Journal of Applied Physics, (1968) pp. 3504–3505.

* cited by examiner

*Primary Examiner*—Kenneth J. Ramsey
(74) *Attorney, Agent, or Firm*—Fitzpatrick, Cella, Harper & Scinto

(57) ABSTRACT

In a method of fabricating an electron-emitting device, an activation step is performed in shorter time.

The method forms a deposit of carbon or carbon compound on a precursory structure which becomes an electron-emitting region in an electron-emitting device made on a substrate and comprises a first step for depositing carbon or carbon compound in a gas atmosphere which includes a carbon compound of a first molecular weight, and subsequently a second step for depositing carbon or carbon compound in a gas atmosphere which includes a carbon compound of a second molecular weight smaller than the first molecular weight.

11 Claims, 22 Drawing Sheets

METHOD OF FABRICATING ELECTRON-EMITTING DEVICE, ELECTRON SOURCE AND IMAGE-FORMING APPARATUS USING THE ELECTRON SOURCE

BACKGROUND OF THE INVENTION

1. Field of the Invention

The present invention relates to a method of fabricating an electron-emitting device, a method of fabricating an electron source and a method of fabricating an image-forming apparatus that uses the electron source.

2. Related Background Art

Among electron-emitting devices, a surface conduction electron-emitting device utilizes a phenomenon in which electron emission is caused by flowing an electric current to a thin film formed with a small area on a substrate and in parallel to the film surface. JP 07-235255 A discloses a surface conduction electron-emitting device that uses a metal thin film made of Pd or the like. FIGS. 1A and 1B schematically show a configuration of the device. In the figures, reference numeral 1 denotes a substrate. Reference numeral 4 denotes an electroconductive film consisting of a metal oxide thin film or the like made of Pd or the like. The electroconductive film 4 is locally destroyed, deformed or denatured by an energization operation called energization forming that will be discussed below to form a gap 5 that is kept in a state of electrically high resistance.

The surface conduction electron-emitting device that was subject to the energization forming operation emits electrons from the above-described gap 5 by a voltage being applied on both the ends of the electroconductive film 4 and an electric current being flown to the device.

Moreover, in order to improve an electron-emitting characteristic, the surface conduction electron-emitting device may be subject to an operation called "activation" as will be discussed below to form a film (carbon film) consisting of carbon/carbon compound in the above-described gap 5 and in its vicinity. This step can be performed by a method of applying a pulse voltage to the device in an atmosphere containing an organic material to cause the carbon/carbon compound to deposit around the gap 5 (EP-A-660357, JP 07-192614 A, JP 07-235255 A and JP 08-07749 A).

The above-described surface conduction electron-emitting device has an advantage in that a number of devices can be arranged and formed over a large area since it is simple in its structure and is easily fabricated. Therefore, its application to a charged beam source, a display apparatus and the like has been studied.

As an example of arranging and forming a lot of surface conduction electron-emitting devices, there is an electron source in which surface conduction electron-emitting devices are arranged in parallel with each other and multiple rows formed by connecting both ends of each of the devices by wirings (common wirings), respectively, are arranged (e.g., JP 64-031332 A, JP 01-283749 A, JP 02-257552 A and the like).

As an example of a display apparatus, there is an image-forming apparatus in which an electron source having a lot of surface conduction electron-emitting devices arranged therein and a phosphor for emitting visible light by an electron emitted from this electron source are combined (e.g., U.S. Pat. No. 5,066,883 B).

In such an image-forming apparatus, some contrivances have been made in steps of forming and activation in order to secure uniformity of a displayed image, and a measure for judging an end of an activation step based on electric characteristics in the activation step is also taken (e.g., JP 09-6399 A).

In addition, as an electron-emitting device other than the above-described surface conduction electron-emitting device, there is a field emission type electron-emitting device (FE: Field Emitter). As an example of this FE, there is a Spindt type FE, which is a micro-cold cathode constituted by a microscopic conical emitter and a control electrode (gate electrode) formed near the emitter and having a function of drawing out an electric current from the emitter and an electric current control function. A cold cathode in which the Spindt type FEs are arranged in an array shape is proposed by C. A. Spindt et al. (C. A. Spindt, A Thin-Film Field-Emission Cathode, Journal of Applied Physics, Vol. 39, No. 7, pp. 3504, 1968). In recent years, in the field of such an FE, a technique is disclosed which applies a voltage to a part between a gate electrode and a cathode electrode connected to the emitter in an atmosphere containing an organic material, thereby causing a carbon compound to deposit on the surface of the emitter to improve an electron-emitting efficiency (JP 10-50206 A).

As an electron source substrate on which a lot of electron-emitting devices are formed, for example, there is an electron source substrate of a passive matrix configuration in which electron-emitting devices are arranged in a matrix shape over N rows and M columns. When the above-described activation step for causing carbon or carbon compound to deposit is applied to such an electron source substrate, a voltage is applied to a common wiring of N rows and M columns, which is connected to a device electrode, by, for example, the following methods. These methods are described in JP 09-134666 A and EP-A-726591.

(1) Applying a voltage line by line from first row to Nth row in order.

(2) Scroll activation for partitioning N rows into a few blocks to sequentially apply a phase-shifted pulse to each block.

However, in both the cases of the above methods (1) and (2), when the number of devices increases, time required for the activation step becomes longer. In addition, if the number of blocks into which N rows are partitioned as in the method (2) is reduced, a duty of a voltage applied to one row falls to slow down an activation and cause drop in an amount of electron emission and an electron-emitting efficiency, whereby a satisfactory electron-emitting device is not obtained.

Thus, it has been attempted to reduce activation time by increasing the number of lines to which a voltage is simultaneously applied. However, the activation step for causing carbon and carbon compound to deposit in an electron-emitting region and in its vicinity is performed by decomposing an organic material adsorbed onto an electron source substrate from the atmosphere. Thus, when the number of devices to which the activation step is simultaneously applied increases, an amount of the organic material to be decomposed and reacted on the electron source substrate per unit time also increases. As a result, a concentration of the organic material in the atmosphere fluctuates, formation of a carbon film is slowed down or a carbon film is formed in a different speed according to positions on the surface of the electron source substrate, whereby uniformity of an obtained electron source is deteriorated.

SUMMARY OF THE INVENTION

The present invention has been devised in view of the above-described drawbacks, and it is an object of the present invention to provide a method of fabricating an electron-emitting device and an electron source that are capable of performing an activation step in shorter time.

In addition, it is another object of the present invention to provide a method of fabricating an electron-emitting device and an electron source that are capable of forming a film of carbon or carbon compound excellent in crystallinity during an activation step in shorter time.

In addition, it is another object of the present invention to provide a method of fabricating an electron source that is capable of performing an activation step in shorter time even in fabrication of an electron source provided with a plurality of electron-emitting devices.

In addition, it is another object of the present invention to provide a method of fabricating an electron source that is capable of fabricating an electron source provided with an electron-emitting device excellent in uniformity in an activation step in shorter time even in fabrication of an electron source provided with a plurality of electron-emitting devices.

Further, it is yet another object of the present invention to provide a method of fabricating an image-forming apparatus that is capable of obtaining an image forming apparatus that can realize a uniform luminance characteristic.

According to one aspect of the present invention, a method of forming a deposit of carbon or carbon compound on a precursory structure which becomes an electron-emitting region in an electron-emitting device made on a substrate, comprises a first step for depositing carbon or carbon compound in a gas atmosphere which includes a carbon compound of a first molecular weight, and subsequently a second step for depositing carbon or carbon compound in a gas atmosphere which includes a carbon compound of a second molecular weight smaller than the first molecular weight.

According to another aspect of the present invention, a method of fabricating an electron-emitting device, comprise a forming step for forming a pair of conductive members which are arranged with a gap and an activation step for depositing carbon or carbon compound on at least one of the conductive members in the pair, wherein the activation step includes at least first and second steps, in the first step the carbon or carbon compound being deposited in a gas atmosphere which includes a carbon compound of a first molecular weight, and in the second step taken succeeding to the first step, the carbon or carbon compound being deposited in a gas atmosphere which includes a carbon compound of a second molecular weight smaller than the first molecular weight.

In the above methods, typically the second step is conducted as the final step in the deposit forming process.

The present invention is a method of fabricating an electron source provided with a plurality of electron-emitting devices and a wiring connected to the plurality of electron-emitting devices on a substrate, wherein the plurality of electron-emitting devices are fabricated by the above-described fabricating method.

In addition, the present invention is a method of fabricating an image-forming apparatus having an electron source and an image-forming member, wherein the electron source is fabricated by the above-described fabricating method.

DESCRIPTION OF THE PREFERRED EMBODIMENTS

Figure 1A:
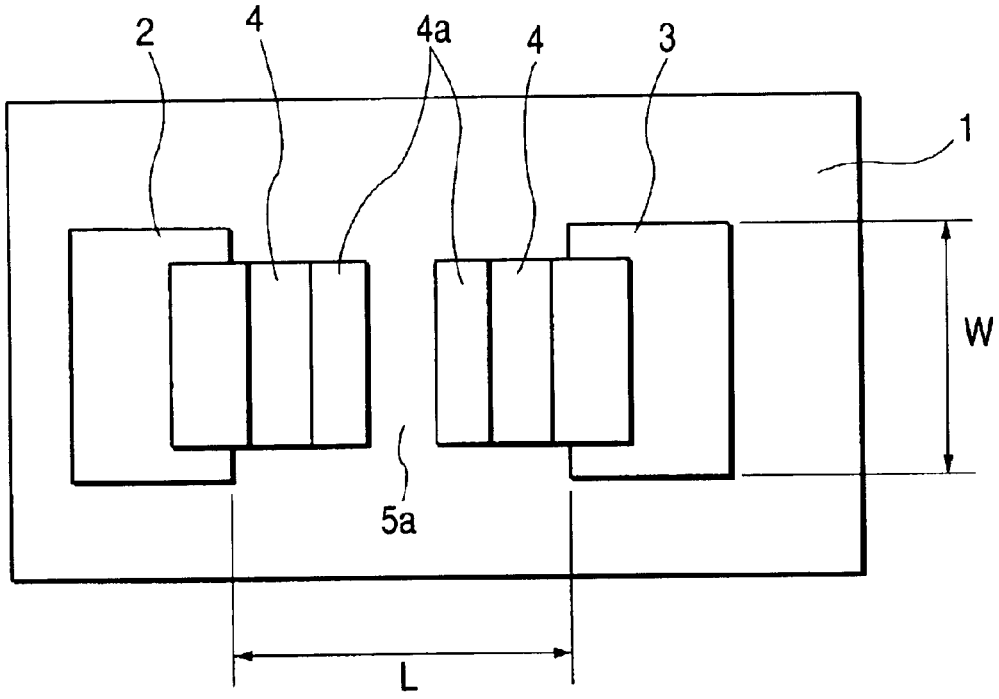
FIG. 1A is a plan view showing an example of an electron-emitting device that is fabricated by a fabricating method of the present invention.

The present invention relates to a method of fabricating an electron-emitting device, comprising a forming step for forming a pair of conductive members which are arranged with a gap on a substrate and an activation step for depositing carbon or carbon compound on at least one of the above-described conductive members in the pair, which is characterized in that the above-described activation step includes a plurality of steps including at least first and second steps: in the above-described first step, the carbon or carbon compound is deposited in a gas atmosphere which includes a carbon compound of a high molecular weight; and in the above-described second step taken succeeding to the above-described first step, the carbon or carbon compound is deposited in a gas atmosphere which includes a carbon compound of a low molecular weight.

The above-described method of fabricating an electron-emitting device of the present invention is further preferably characterized in that:

- the above-described second step is a final step in the above-described plurality of steps;
- the above-described first step is performed in an atmosphere of a carbon compound gas with a molecular weight of 100 or more and the above-described second step is performed in the atmosphere of a carbon compound gas with a molecular weight of less than 100;
- the carbon compound gas in the above-described first step is either tolunitrile or benzonitrile;
- the carbon compound gas in the second step is any one of methane, ethane, propane, ethylene, propylene and acetylene,
- a hydrogen gas is mixed in the gas atmosphere in the above-described second step;
- the above-described precursory structure is a pair of electric conductors spaced apart from each other to be arranged on a substrate;
- the above-described step of depositing carbon or carbon compound is a step of applying a voltage to the part between the above-described pair of electric conductors in the above-described gas atmosphere;
- the above-described pair of electric conductors consist of a pair of electroconductive films spaced apart from each other to be arranged, or the above-described pair of electric conductors consist of a pair of electroconductive films spaced apart from each other to be arranged and a pair of electrodes connected to each of the pair of electroconductive films; and
- the above-described step of forming a pair of electroconductive films has a step of applying a voltage to an electroconductive film formed on the above-described substrate to form the above-described gap in the electroconductive film.

The present invention relates to a method of fabricating an electron-emitting device, comprising a forming step for forming an electroconductive film including an electron-emitting region between a pair of electrodes arranged on a substrate and an activation step for depositing carbon or carbon compound on the above-described electroconductive film, which is characterized in that the above-described activation step includes a plurality of steps including at least first and second steps: in the above-described first step, the carbon or carbon compound is deposited in a gas atmosphere which includes a carbon compound of a high molecular weight; and in the above-described second step taken succeeding to the above-described first step, the carbon or carbon compound is deposited in a gas atmosphere which includes a carbon compound of a low molecular weight.

The method of fabricating an electron-emitting device of the present invention is further preferably characterized in that:

- the above-described second step is a final step in the above-described plurality of steps;
- the above-described first step is performed in an atmosphere of a carbon compound gas with a molecular weight of 100 or more and the above-described second step is performed in the atmosphere of a carbon compound gas with a molecular weight of less than 100;
- the carbon compound gas in the above-described first step is one selected from the group consisting of tolunitrile and benzonitrile;
- the carbon compound gas in the above-described second step is one selected from the group consisting of methane, ethane, propane, ethylene, propylene and acetylene;
- a hydrogen gas is mixed in the carbon compound gas in the above-described second step;
- the above-described activation step is a step of applying a voltage to the above-described electroconductive film including the electron-emitting region in the above-described atmosphere of the carbon compound gas; and
- the step of forming the above-described electroconductive film including the electron-emitting region has a step of applying a voltage to the electroconductive film.

Also, the present invention relates to a method of fabricating an electron source provided with a plurality of electron-emitting devices and wirings connected to the plurality of electron-emitting devices on a substrate, which is characterized in that the above-described plurality of electron-emitting devices are fabricated by a fabricating method of an electron-emitting device according to any one of the above aspects of the present invention.

Further, the present invention relates to a method of fabricating an image-forming apparatus including an electron source and an image-forming member, which is characterized in that the above-described electron source is fabricated by a fabricating method of an electron source according to the above aspect of the present invention.

According to such a method of fabricating an electron-emitting device of the present invention, since a film of carbon or carbon compound excellent in crystallinity can be deposited in shorter time, stability of characteristics can be realized.

In addition, according to such a method of fabricating an electron source of the present invention, since a supply amount of a carbon compound gas never runs short even if an activation step is simultaneously applied to a plurality of devices, decrease of uniformity of an electron-emitting characteristic due to an insufficient supply amount of the carbon compound gas can be inhibited. Moreover, since the electron-emitting characteristic is optimized by, in particular, performing the above-described second step for depositing the carbon or the carbon compound in the atmosphere of a carbon compound gas with a molecular weight of less than 100, uniformity is improved.

Moreover, according to such a method of fabricating an electron source, in which a plurality of electron-emitting devices are arranged, of the present invention, since an activation step can be simultaneously applied to a plurality of devices to fabricate an electron source having a more uniform electron-emitting characteristic, an inexpensive and highly uniform electron source and an inexpensive and high-grade image forming apparatus can be provided by the decrease of production costs due to shortened tact time of a fabricating step.

An electron-emitting device in accordance with the present invention has a pair of electric conductors spaced apart from each other to be arranged on a substrate and is an electron-emitting device for emitting an electron by a voltage being applied to the pair of electric conductors. For example, the electron-emitting device includes the foregoing surface conduction electron-emitting device and field emission electron-emitting device that is called FE. Here, in the case of the FE, the above-described pair of electric conductors correspond to the foregoing emitter and gate electrode. Carbon or carbon compound is deposited on the emitter. In addition, in the case of the surface conduction electron-emitting device, the above-described pair of electric conductors correspond to a pair of electroconductive films discussed in detail below. Carbon or carbon compound is deposited on one or both of the pair of electroconductive films. Preferred embodiment modes of the present invention will be hereinafter described citing the surface conduction electron-emitting device as an example of the electron-emitting device.

Figure 1B:
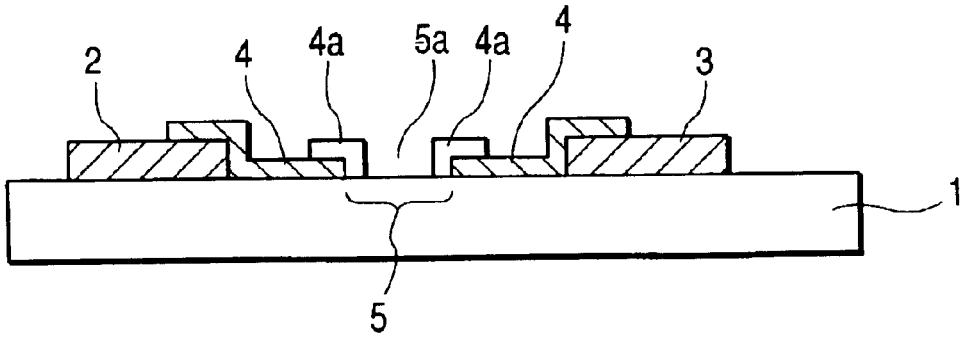
FIG. 1B is a sectional view showing an example of an electron-emitting device that is fabricated by a fabricating method of the present invention.

FIGS. 1A and 1B are a plan view and a sectional view of a surface conduction electron-emitting device, respectively. In FIGS. 1A and 1B, reference numeral 1 denotes a substrate, 2 and 3 denote device electrodes, 4 denotes a pair of electroconductive film connected to the respective device electrodes 2 and 3 with a first gap 5 between them, and 4*a* denotes a carbon film consisting of carbon or carbon compound as a main component, which is disposed on the electroconductive film 4 and in the first gap and forms a second gap 5*a* narrower than the first gap 5. The above-described surface conduction electron-emitting device emits electrons from the electroconductive film by a voltage being applied between the device electrodes 2 and 3.

As the substrate 1, quartz glass, glass with a reduced content of impurities such as Na, soda lime glass, a glass substrate fabricated by laminating SiO2 formed by sputtering or the like on soda lime glass, ceramics such as aluminum, an Si substrate or the like can be used.

As a material of the opposing device electrodes 2 and 3, a general conductor material can be used. An interval L between device electrodes, a length W of a device electrode, a shape of the electroconductive film 4 and the like are designed taking into account a form in which it is applied, or the like.

Further, besides the configuration shown in FIGS. 1A and 1B, the surface conduction electron-emitting device may have a configuration in which the electroconductive film 4 and the opposing device electrodes 2 and 3 are laminated on the substrate 1 in this order.

It is preferable to use a particulate film formed of particulates as the electroconductive film 4 in order to realize a favorable electron-emitting characteristic. The particulate film described herein is a film in which a plurality of particulates are collected. Its microstructure takes a state in which the particulates are dispersedly arranged individually or a state in which the particulates are adjacent to one another or superposed onto one another (including the case in which several particulates are collected to form an island-like structure as a whole). A particulate diameter of the particulates is in the range of several hundred pm to several hundred nm and, more preferably, in the range of 1 nm to 20 nm.

A film thickness of the electroconductive film 4 is appropriately set taking into account a step coverage to the device electrodes 2 and 3, a resistance value between the device electrodes 2 and 3, forming conditions discussed below and the like. It is usually preferable to set the film thickness in the range of several hundred pm to several hundred nm and, more preferably, in the range of 1 nm to 50 nm. The resistance value is a value with Rs from $10^2$ Ω/□ to $10^7$ Ω/□. Further, Rs is an amount that appears when a resistance R of a thin film with a width w and a length l is given as R=Rs(l/w).

A material forming the electroconductive film 4 is appropriately selected out of metal such as Pd, Pt, Ru, Ag, Au, Ti, In, Cu, Cr, Fe, Zn, Sn, Ta, W and Pb, and oxide such as PdO, $SnO_2$, $In_2O_3$, PbO and $Sb_2O_3$.

The first gap 5 is constituted by a fissure formed in a part of the electroconductive film 4 and depends on a film thickness, a film quality and a material of the electroconductive film 4, a method such as energization forming discussed below, and the like. The carbon film 4*a* of carbon or carbon compound is placed in the first gap 5 or on the electroconductive film 4 in its vicinity.

An example of the method of fabricating an electron-emitting device of the present invention will be described with reference to FIGS. 2A through 2D to 5. In FIGS. 2A through 2D to 5, the same parts as shown in FIGS. 1A and 1B are denoted by the identical symbols.

Figure 2A:
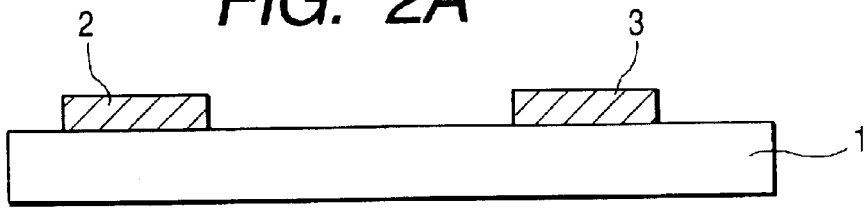
FIGS. 2A, 2B, 2C and 2D are sectional views for illustrating a method of fabricating an electron-emitting device of the present invention.
Figure 2B:
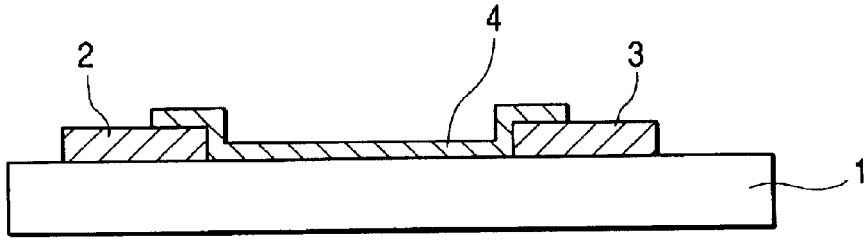
Figure 2C:
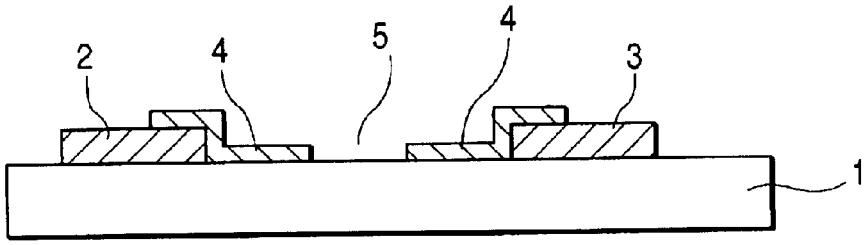

1) The substrate 1 is sufficiently cleaned using detergent, pure water, organic solvent or the like, and a device electrode material is deposited thereon by the vacuum evaporation method, the sputtering method or the like. Then, the device electrodes 2 and 3 are formed on the substrate 1 using, for example, the photolithography technique (FIG. 2A).
2) An organic metal solution is applied onto the substrate 1 provided with the device electrodes 2 and 3 to form an organic metal thin film. As the organic metal solution, a solution of an organic metal compound can be used, which contains a metal of the material of the foregoing electroconductive film 4 as a main element. Then, the organic metal thin film is subject to heating/baking operation and patterned by lift-off, etching or the like to form the electroconductive film 4 (FIG. 2B). Although the method of applying the organic metal solution is exemplified here, the method of forming the electroconductive film 4 is not limited to this and other methods such as vacuum evaporation, sputtering, chemical vapor deposition, dispersing application, dipping and spinner can be used as well.
3) Subsequently, a forming step is applied. Although the forming step will be described by exemplifying energization operation here, forming operation is not limited to this but includes operation for generating a gap such as a fissure in the electroconductive film 4 to form a high resistance state. When energization is applied to the part between the device electrodes 2 and 3 using a not-shown power source, the first gap 5 including a fissure with a changed structure is formed in a part of the electroconductive film 4 (FIG. 2C). Further, an electron-emitting region is formed in the electroconductive film 4 by the first gap 5 being formed. When a voltage is applied to the part between the device electrodes 2 and 3, electrons are emitted from the vicinity of the first gap 5.

Figure 3A:
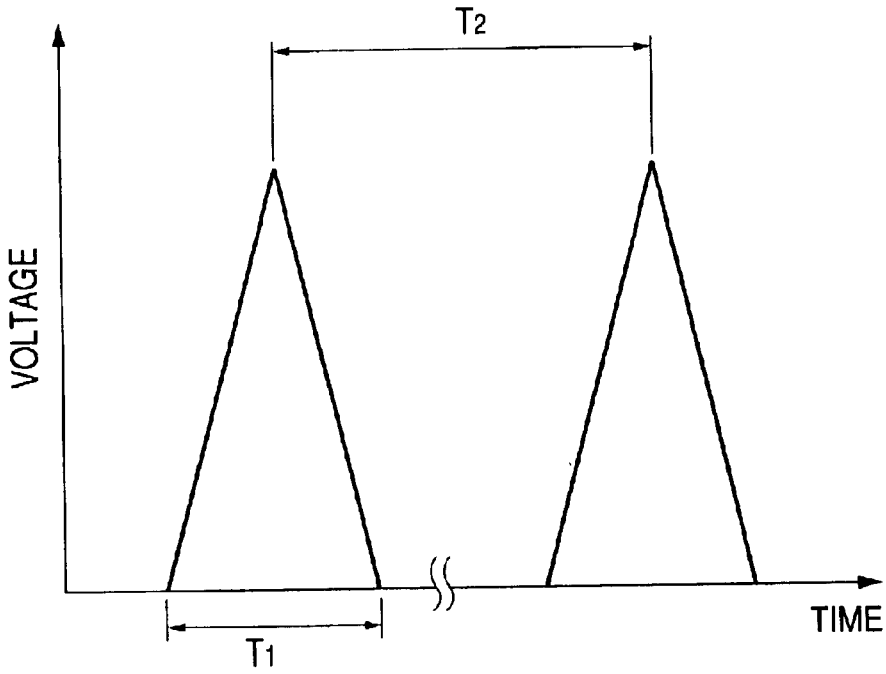
FIGS. 3A and 3B are graphs showing an example of a forming voltage.
Figure 3B:
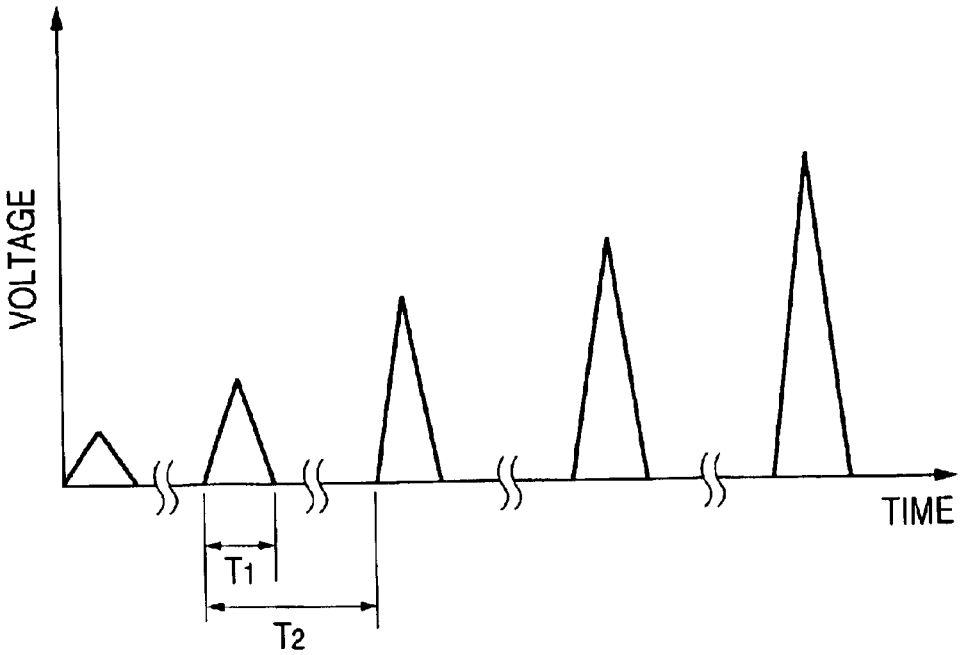

FIGS. 3A and 3B show examples of a voltage waveform of energization forming. The voltage waveform is preferably a pulse waveform. For generating the pulse waveform, there is a method of continuously applying a pulse with a pulse peak value as a constant voltage as shown in FIG. 3A and a method of applying a voltage pulse while increasing a pulse peak value as shown in FIG. 3B.

4) Operation called an activation step is applied to the device which has undergone the forming. The activation step is a step in which a device current If and an emission current Ie change considerably by this step. The activation step can be performed, for example, by repeating the application of pulses as in the energization forming under an atmosphere containing a carbon compound gas such as an organic material gas. In this case, a preferable pressure of the organic material gas is appropriately set as required because it varies according to the forgoing form of application, a shape of a vacuum container in which devices are arranged, a type of the organic material and the like.

Figure 2D:
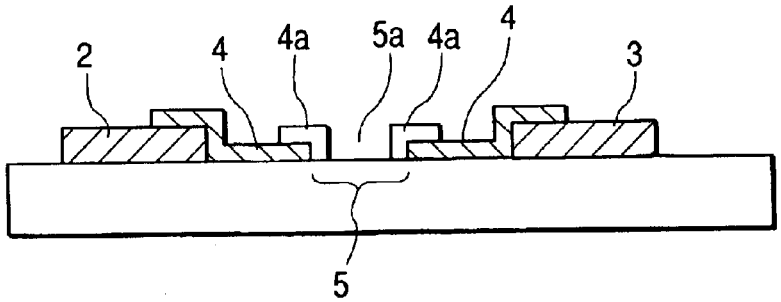

The carbon film 4*a* consisting of carbon or carbon compound deposits on the electroconductive film 4 and in the first gap 5 from the organic material existing in the atmosphere by this operation. The device current If and the emission current Ie change significantly by forming the second gap 5*a*, which is narrower than the first gap 5, in and along the first gap 5 (FIG. 2D).

Here, the carbon and carbon compound refer to, for example, graphite (indicating both monocrystal graphite and polycrystal graphite) and amorphous carbon (indicating amorphous carbon and a mixture of amorphous carbon and polycrystal graphite). Its film thickness is preferably in the range of less than 50 nm and, more preferably, in the range of less than 30 nm.

Suitable organic materials that can be used in the present invention include aliphatic hydrocarbons such as alkane, alkene and alkyne, aromatic hydrocarbons, alcohols, aldehydes, ketones, amines, and organic acids such as phenol, carvone and sulfonic acid. More specifically, saturated hydrocarbon expressed by $CnH_{2n+2}$ such as methane, ethane or propane, unsaturated hydrocarbon expressed by composition formula $CnH_{2n}$, $CnH_{2n-2}$ or the like such as ethylene, propylene or acetylene, tolunitrile, benzonitrile, benzene, methanol, ethanol, formaldehyde, acetaldehyde, acetone, methylethylketone, methylamine, ethylamine, phenol, formic acid, acetic acid, propionic acid, etc. may be employed.

In the present invention, these organic materials may be used individually or may be used in mixture, if necessary. In addition, these organic materials may be diluted by other gases, which are not the organic materials, to be used. A type of a gas that can be used as a dilution gas includes, for example, an inactive gas such as nitrogen, argon or xenon.

The present invention is characterized in that the activation step consists of two or more steps including a first step and a second step, the first step being performed in the atmosphere of a carbon compound gas of a high molecular weight and the second step being performed in the atmosphere of a carbon compound gas of a low molecular weight.

The activation step of the first stage (first step) is a step mainly for depositing a carbon film in the electron-emitting region formed in the forming step. Thus, a relatively large amount of organic materials is reacted, a concentration of organic materials in the atmosphere fluctuates and formation of a carbon film is slowed down. In addition, in particular, with an electron source in which many electron-emitting devices are arranged, since a difference in an concentration of organic materials in the atmosphere occurs according to a position on a surface of the substrate or a difference in a speed of forming a carbon film occurs for each device, a characteristic of each electron-emitting device obtained tends to be dispersed.

Therefore, in the present invention, an organic material of a relatively high molecular weight among the foregoing organic materials is used for the activation atmosphere of the first step. That is, since an organic material of a high molecular weight has a large intermolecular force and a long residence time on a substrate surface, fluctuation of a partial pressure of the organic material in an activation atmosphere is small even if the organic material is reacted. In particular, when many electron-emitting devices are fabricated, an electron-emitting device with good uniformity can be obtained in an activation step in shorter time.

On the other hand, the activation step of the second stage (second step) is considered a step mainly for reinforcing the carbon film deposited in the first stage. The device activated in the first stage is turned into a state in which a device current flows by the deposition of the carbon film and in addition, electrons are emitted therefrom. Thus, it is surmised that a majority of energy generated in the vicinity of the fissure by local heating following the device current and irradiation of emitted electrons can be utilized for improvement of crystallinity of the carbon film depositing at this point if the deposition of carbon onto the vicinity of the fissure (gap) is controlled to be slowed down in the second step.

Therefore, in the present invention, an organic material of a relatively low molecular weight among the foregoing organic materials is used as the activation atmosphere of the second step. That is, the organic material of a low molecular weight has a short residence time on a substrate surface of the organic material and it becomes easy to control a speed of deposition of carbon onto the vicinity of the fissure (gap) due to a partial pressure of the organic material in the atmosphere. As a result, it becomes possible to slow down the deposition of carbon with ease and with good controllability by, for example, partial pressure control for slowing down the deposition of carbon onto the vicinity of the fissure or introduction of a gas having an etching action such as a hydrogen gas.

From the surmise of the above-described phenomenon, an organic material of a molecular weight of 100 or more is preferable and, in particular, tolunitrile, benzonitrile and the like are preferable as the organic material of a high molecular weight in the activation step of the first stage. In addition, as the organic material of a low molecular weight in the activation step of the second stage, an organic material of a molecular weight of less than 100 is preferable and, in particular, methane, ethane, propane, ethylene, propylene, acetylene and the like are preferable.

In the present invention, as to the method of applying a voltage in the activation step, conditions such as a change in time of a voltage value, a direction of applying a voltage and a waveform are considered. The change in time of a voltage value can be performed by a method of increasing a voltage value along with time. Alternatively, a voltage can be applied at a fixed voltage.

Figure 4A:
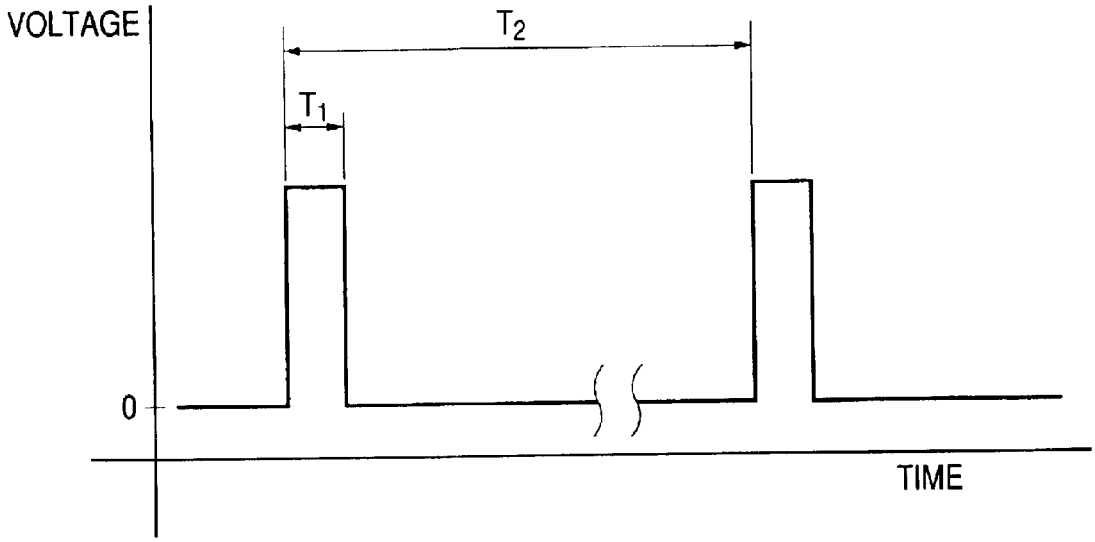
FIGS. 4A and 4B are graphs showing an example of an activation voltage.
Figure 4B:
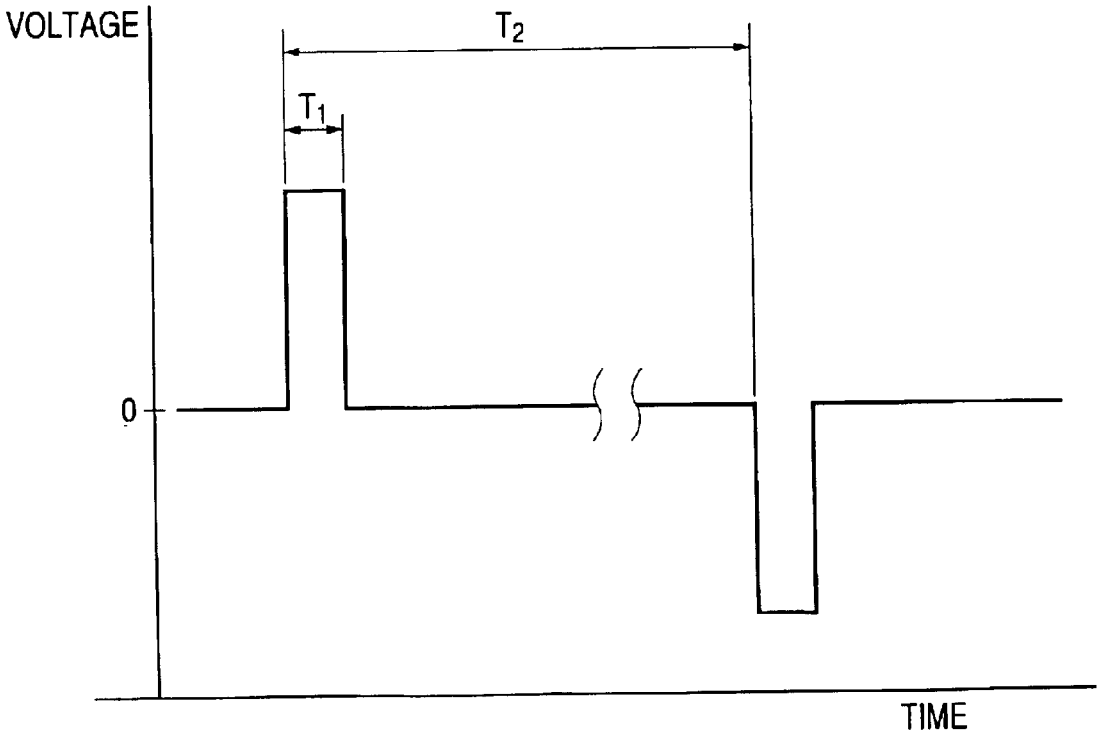

In addition, as shown in FIGS. 4A and 4B, a voltage may be applied only in the same direction as driving (forward direction) (FIG. 4A) or may be applied by alternately changing the forward direction and reverse direction (FIG.

4B). It is preferable to apply a voltage alternately because a carbon film seems to be formed symmetrically with respect to a fissure (gap). In addition, although an example of a rectangular wave is shown in FIGS. 4A and 4B, any waveform such as a sine wave, a triangle wave and a sawtooth wave can be used.

5) A stabilization step is preferably performed to the electron-emitting device obtained through such steps. This step is a step for exhausting organic materials in a vacuum container in which the electron-emitting device is arranged. As an evacuator for evacuating the vacuum container, it is preferable to use an evacuator not using oil such that oil generated from the apparatus does not affect a characteristic of the device. More specifically, there can be given evacuators such as a sorption pump and an ion pump. A partial pressure of an organic component in the vacuum container is preferably $1.3\times10^{-6}$ Pa or less, which is a partial pressure at which the above-described carbon and carbon compound do not substantially deposit anew and, in particular, $1.3\times10^{-8}$ Pa or less.

Moreover, when evacuating the vacuum container, it is preferable to heat the entire vacuum container to make it easier to discharge organic material molecules absorbed in the wall inside the vacuum container or in the electron-emitting device. As to heating conditions at this point, it is desirable to heat the vacuum container at temperature of 80 to 250° C., preferably 150° C. or more and for a period as long as possible. However, the heating is not specifically limited to these conditions and may be performed according to conditions that are appropriately selected depending on a size and a form of the vacuum container, a configuration of the electron-emitting device and the like. A pressure inside the vacuum container is required to be kept as low as possible, and is preferably $1\times10^{-5}$ Pa or less and, in particular, $1.3\times10^{-8}$ Pa or less.

As to an atmosphere at the time of driving after the completion of the stabilization step, it is preferable to keep the atmosphere at the end of the above-described stabilization step. However, the atmosphere at the time of driving is not limited to this and a sufficiently stable characteristic can be maintained even if a pressure itself rises more or less as long as organic materials are sufficiently removed. By employing such a vacuum atmosphere, deposition of new carbon or carbon compound can be inhibited and $H_2O$, $O_2$ and the like absorbed in the vacuum container and the substrate can also be removed. As a result, the device current If and the emission current Ie are stabilized.

In addition, the fabricating method of the present invention is a method of fabricating an electron source in which a plurality of electron-emitting devices obtained as described above are arranged on a substrate.

Concerning an arrangement of the electron-emitting devices, there is an arrangement in which a plurality of electron-emitting devices are arranged in a matrix shape in a row direction and a column direction, one group of electrodes of the plurality of electron-emitting devices arranged in the same row are commonly connected to wirings in the row direction and the other group of electrodes of the plurality of the electron-emitting devices arranged in the same column are commonly connected to wirings in the column direction. This arrangement is a so-called passive matrix arrangement.

Figure 5:
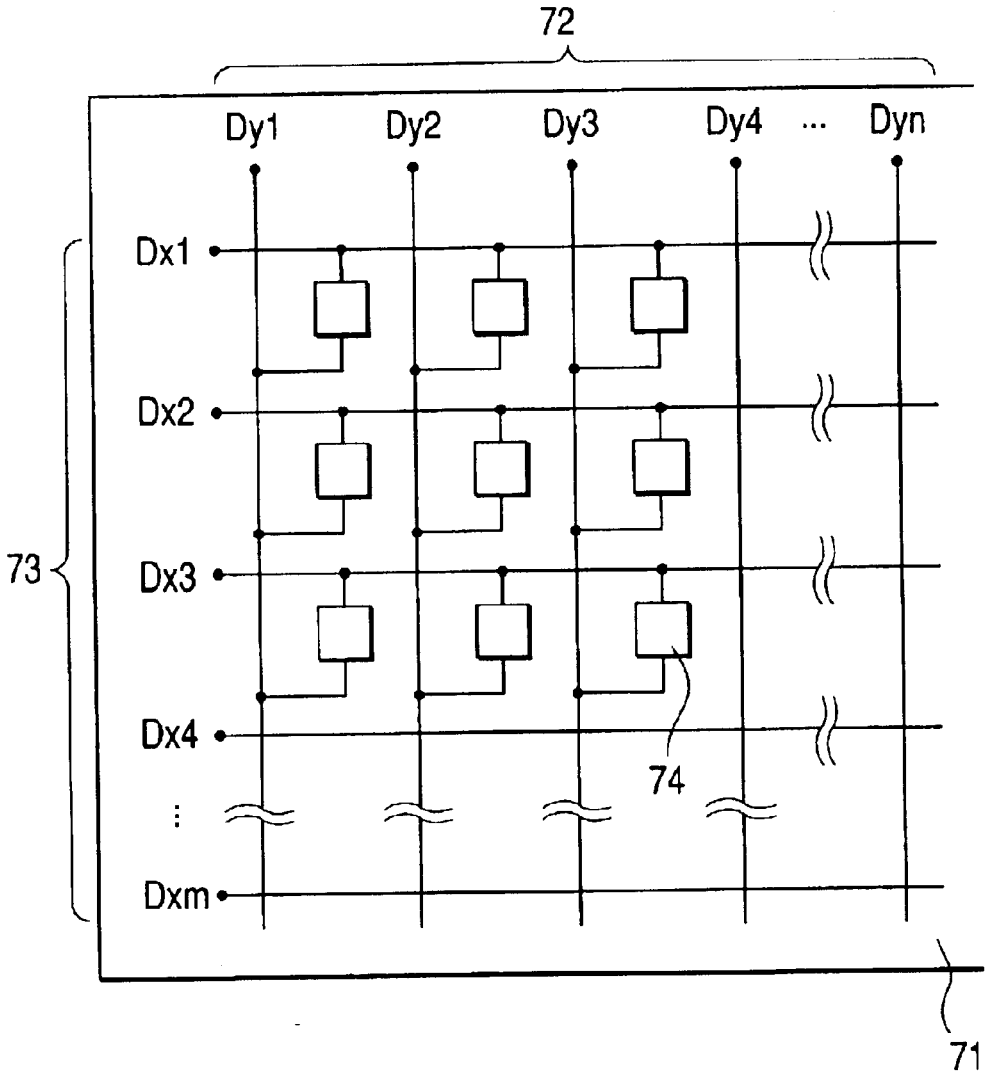
FIG. 5 is a schematic view showing a matrix arrangement of a plurality of electron-emitting devices.

First, the passive matrix arrangement will be described in detail below. In FIG. 5, reference numeral 71 denotes an electron source substrate, 72 denotes column-directional wirings and 73 denotes row-directional wirings. Reference numeral 74 denotes electron-emitting devices.

The column-directional wirings 72 and the row-directional wirings 73 are extracted as external terminals, respectively. These wirings can be made of an electroconductive metal or the like that is formed using the vacuum evaporation method, the printing method, the sputtering method or the like. A material, a film thickness and width of the wirings are appropriately designed.

In addition, not-shown interlayer insulating layers are provided among the m row-directional wirings 73 and n column-directional wirings 72 and electrically separate both the wirings (both m and n are positive integers). The not-shown interlayer insulating layers are made of $SiO_2$ or the like that is formed using the vacuum evaporation method, the printing method, the sputtering method or the like. For example, the interlayer insulating layers are formed in a desired shape on the entire surface or a part of the substrate 71 on which the column-directional wirings 72 are formed. A film thickness, a material and a fabricating method of the interlayer insulating layer are appropriately set such that it can resist a potential difference at intersections of the column-directional wirings 72 and the row-directional wirings 73.

A pair of electrodes (not shown) constituting the electron-emitting devices 74 are electrically connected to the m row-directional wirings 73 and the n column-directional wirings 72, respectively.

Figure 6:
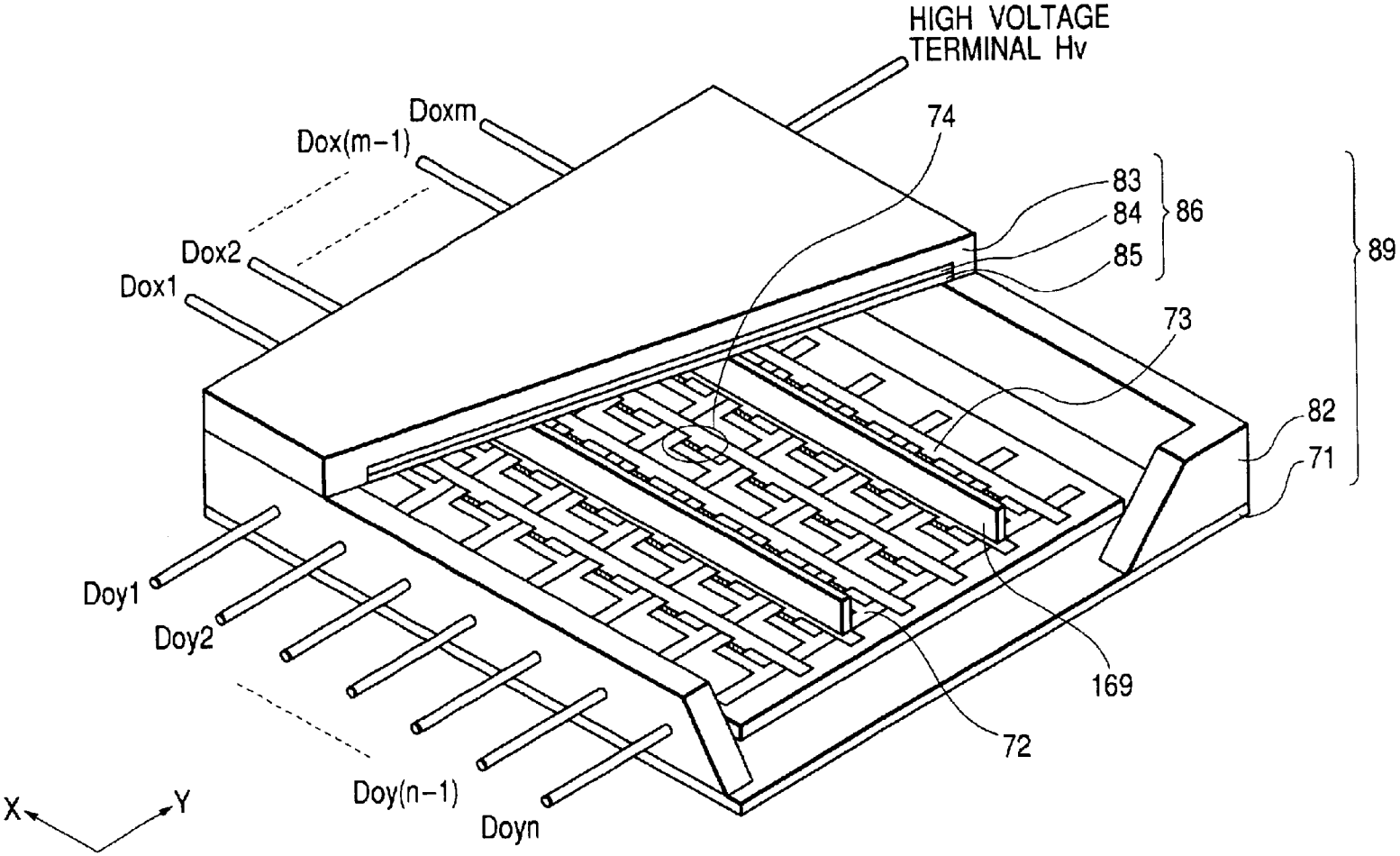
FIG. 6 is a schematic view showing an example of an image-forming apparatus (display panel), which is fabricated by a fabricating method of the present invention, with a part cut away.
Figure 7A:
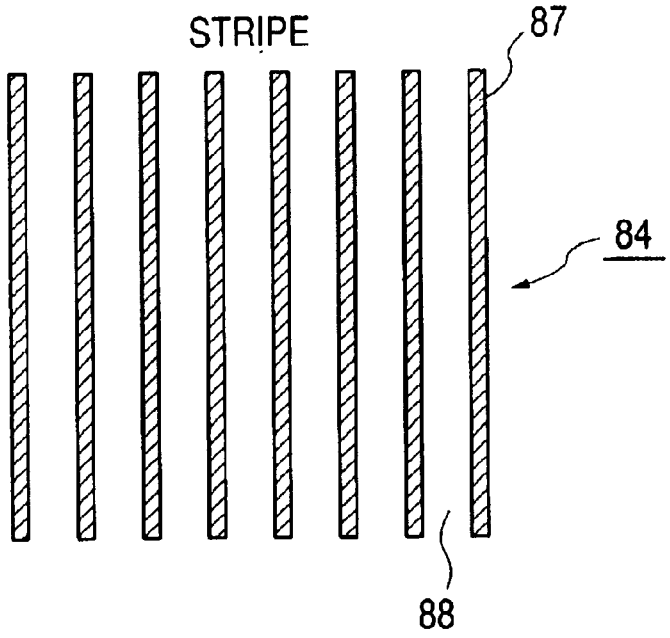
FIGS. 7A and 7B show examples of a fluorescent film.
Figure 7B:
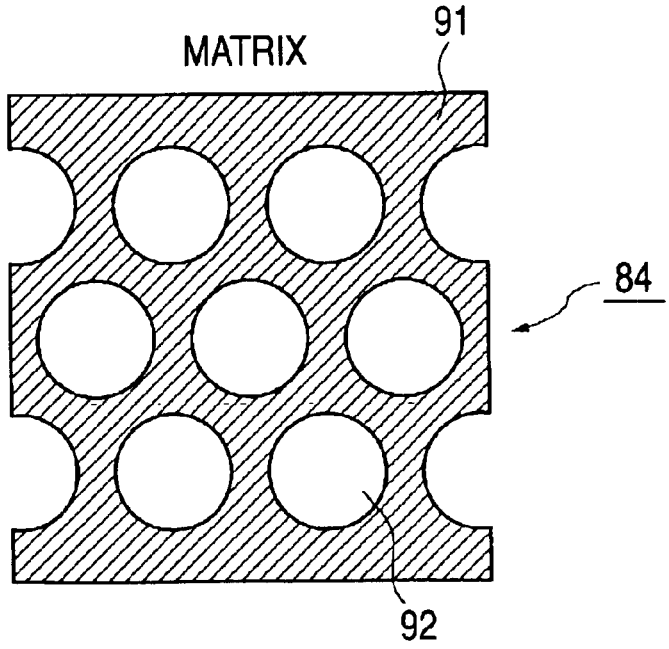

An image-forming apparatus constituted by using the electron source of such a passive matrix arrangement will be described with reference to FIGS. 6, 7A and 7B. FIG. 6 is a schematic view showing an example of a display panel of the image-forming apparatus. FIGS. 7A and 7B are schematic views showing an example of a fluorescent film used in the image-forming apparatus of FIG. 6.

In FIG. 6, reference numeral 71 denotes an electron source substrate on which a plurality of electron-emitting devices 74 are arranged and 86 denotes a face plate in which a fluorescent film 84, a metal back 85 and the like are formed on the inner surface of a glass substrate 83. Reference numeral 82 denotes a supporting frame, to which the electron source substrate (rear plate) 71 and the face plate 86 are joined using a frit glass of a low melting point to form an envelope 89. Reference numerals 72 and 73 denote a column-directional wiring and a row-directional wiring connected to a pair of device electrodes of an electron-emitting device.

In addition, a spacer 169 is disposed between the face plate 86 and the rear plate (electron source substrate) 71, whereby the envelope 89 having a sufficient strength against the atmospheric pressure is constituted.

FIGS. 7A and 7B are schematic views showing the fluorescent film 84. The fluorescent film 84 can be constituted only by phosphors if it is monochrome. In the case of a color fluorescent film, it can be constituted by a black electroconductive material 87, which is called a black stripe (FIG. 7A) or a black matrix (FIG. 7B) according to an arrangement of phosphors, and phosphors 88. Purposes of providing the black stripe or the black matrix reside in coloring dividing parts of the required three primary colors and each phosphor 88 in black to make mixed colors less conspicuous and restraining decrease of contrast due to external light reflection in the fluorescent film 84. As a material of the black electroconductive material 87, a material having conductivity and little transmission and reflection of light can be used in addition to a material containing black lead as a main component which is usually used.

As a method of applying a phosphor onto the glass substrate 83, the sedimentation method, the printing method and the like can be used regardless of whether the fluorescent film 84 is monochrome or color.

The metal back 85 is usually provided on the internal side of the fluorescent film 84. Purposes of providing the metal back reside in improving luminance by reflecting light to the internal side among emitted light of the phosphor by specular reflection to the face plate 86 side, causing the metal back to act as an electrode for applying an electron beam accelerating voltage, protecting the phosphor from damages due to collision of negative ions occurring in the envelope, and the like. The metal back can be fabricated by performing a smoothing operation (usually called "filming") of the internal side surface of a fluorescent film after the formation of the fluorescent film, and then, depositing Al using vacuum evaporation or the like.

In order to further increase electrical conductivity of the fluorescent film 84, a transparent electrode (not shown) may be provided on the external side of the fluorescent film 84 in the face plate 86.

In performing the foregoing sealing, it is necessary to associate a phosphor of each color with an electron-emitting device in the case of a color fluorescent film, and sufficient alignment is indispensable.

An example of the method of fabricating an image-forming apparatus shown in FIG. 6 will be hereinafter described.

Figure 8:
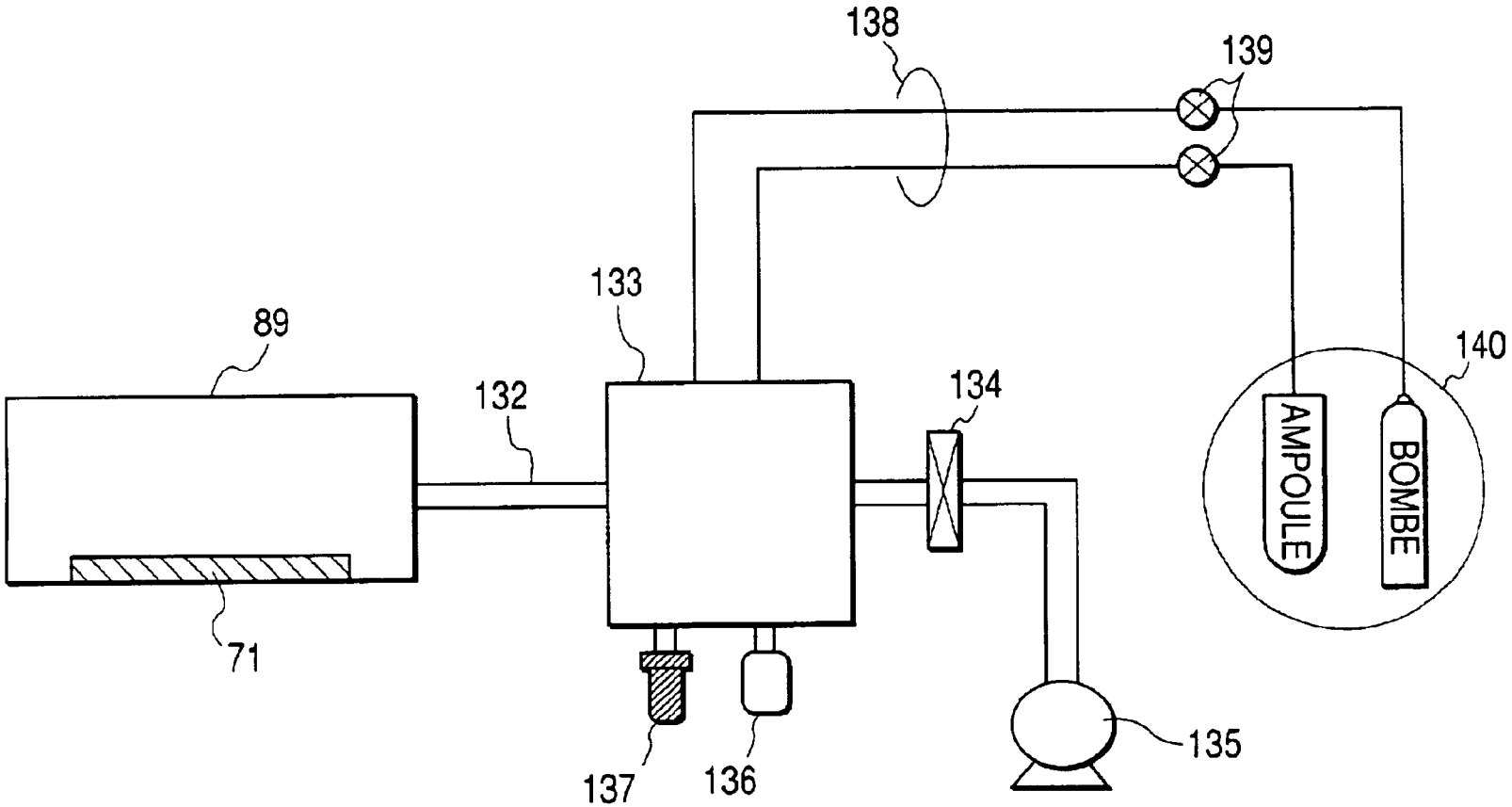
FIG. 8 is a schematic view showing an example of a vacuum apparatus for performing an activation operation in accordance with the present invention.

FIG. 8 is a schematic view showing a configuration of an apparatus that is used in a fabricating step of the image-forming apparatus. The forming step and subsequent steps can be performed by this apparatus.

As shown in FIG. 8, an exhaust pipe 132 is provided in the obtained envelope 89. The envelope 89 is coupled to a vacuum chamber 133 via the exhaust pipe 132 and further connected to an evacuator 135 via a gate valve 134.

A pressure gauge 136, a quadrupole weight analyzer 137 and the like are attached to the vacuum chamber 133 in order to measure a pressure inside it and a partial pressure of each component in the atmosphere. Since it is difficult to directly measure an pressure inside the envelope 89, a pressure inside the vacuum chamber 133 is measured to control conditions for an operation.

Moreover, a gas introducing line 138 is connected to the vacuum chamber 133 in order to introduce a necessary gas into the vacuum chamber 133 to control the atmosphere. A source of a material to be introduced 140 is connected to the other end of the gas introducing line 138, in which the material to be introduced is contained in an ampule or a tank to be stored.

An introducing amount control means 139 for controlling a rate of introducing a material to be introduced is provided in the middle of the gas introducing line 138. More specifically, as the introducing amount control means 139, a valve capable of controlling a releasing flow rate such as a slow leak valve, a mass flow controller and the like can be used, respectively, according to a type of a material to be introduced.

After the inside of the envelope 89 is evacuated by the apparatus of FIG. 8, an organic material is introduced from the gas introducing line 138. In addition, it is possible to connect the ends of the row-directional wirings and the column-directional wirings on the electron source substrate 71 of the envelope 89 with a power source (not shown) via cables (not shown) to apply a voltage to the wirings on the electron source substrate 71 from the power source.

Figure 9:
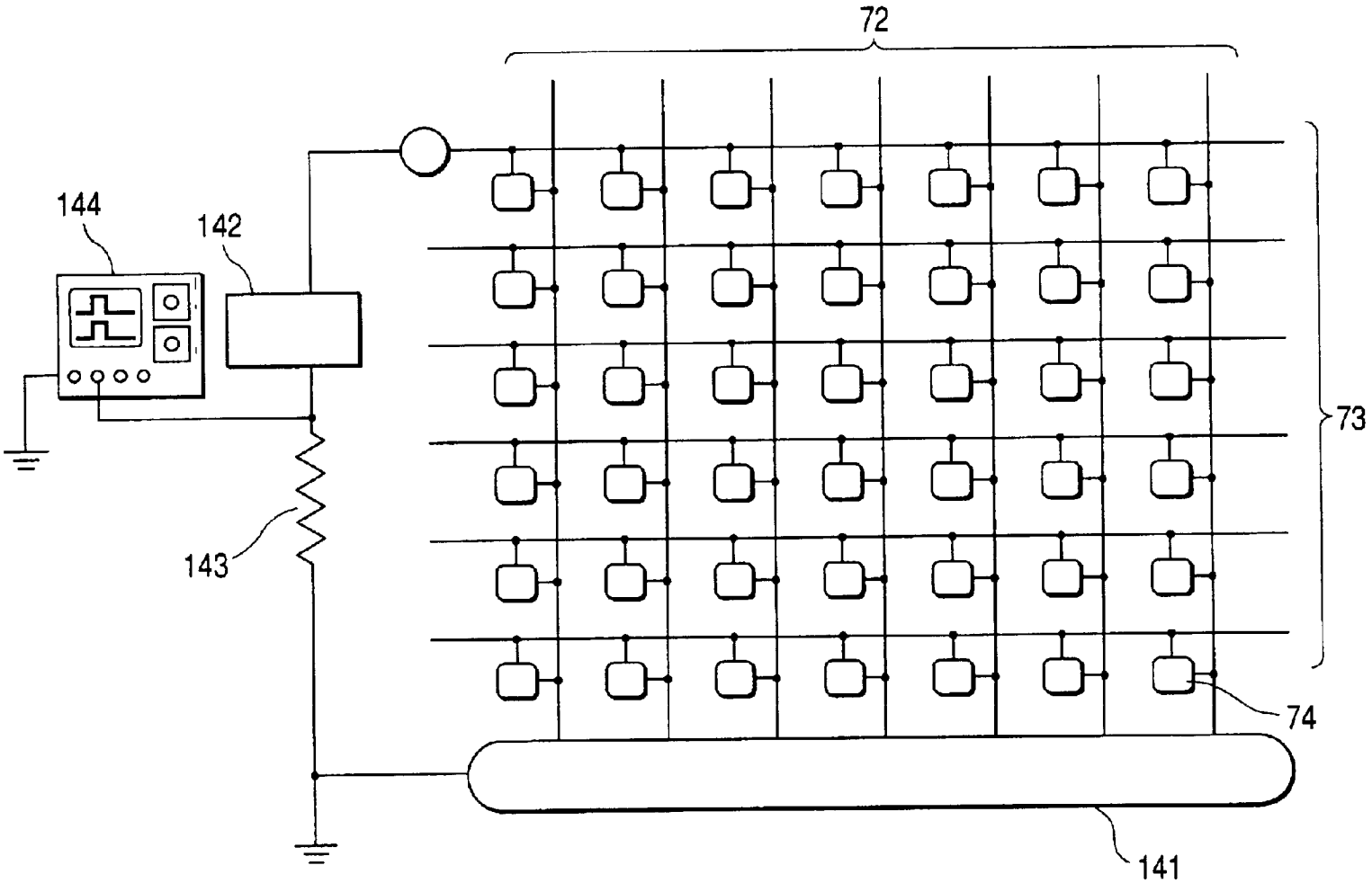
FIG. 9 is a schematic view showing a method of connecting wirings for a forming step and an activation step in accordance with the present invention.

In addition, as shown in FIG. 9, only the column-directional wirings 72 are commonly connected to an electrode and a phase-shifted pulse is sequentially applied (scrolled) to the row-directional wirings 73, whereby a voltage can be applied to the entire electroconductive film 4 in an electron source substrate. In the figure, reference numeral 143 denotes a resistance for measuring an electric current and 144 denotes an oscilloscope for measuring an electric current. The forming step can employ the same method as described concerning an individual device.

The fabricating method of the present invention is characterized in that the activation step is divided into at least two or more stages to be performed as described above. The activation step for depositing carbon and carbon compound in a first gap of an electroconductive film and in its vicinity is performed by decomposing an organic material adsorbed in an electron source substrate from the atmosphere. In the case in which the activation step is performed with respect to an electron source substrate on which many electron-emitting devices are formed and, in particular, in the case in which the number of devices to which a voltage is simultaneously applied is increased in order to reduce time of the activation step, an amount of the organic material to be decomposed and reacted on the electron source substrate increases significantly.

Generally, in the case of the activation step, if a molecular weight of an organic material in the atmosphere is small, a residence time on a substrate surface is short and an organic material reacted in the activation step is affected by a concentration of the organic material in the atmosphere. Therefore, uniformity of an electron emission characteristic may be damaged by distribution and fluctuation of the concentration of the organic material in the atmosphere.

Thus, the inventor of the present invention has employed a method of a two stage activation for dividing the activation step into two stages to perform activation under an atmosphere containing an organic material of a high molecular weight (preferably a molecular weight of 100 or more) in a step of a first stage and, then, perform activation under the atmosphere containing an organic material of a low molecular weight (preferably a molecular weight of less than 100). Consequently, it has become possible to perform activation of many devices with high uniformity of an electron emission characteristic in short time without being affected by distribution and fluctuation of the concentration of the organic material in the atmosphere.

The inventor earnestly examined the activation step and, as a result, it has been found that tolunitrile, benzonitrile and the like are preferable as an organic material in the step of the first stage, and methane, ethane, propane, ethylene, propylene, acetylene and the like are preferable as an organic material in the step of the second stage. Moreover, it has been found that it is preferable to introduce a hydrogen gas in the step of the second stage.

After the activation step, it is preferable to perform the stabilization step as in the case of the individual device. More specifically, while being heated to and kept at the temperature of 80 to 250° C., the envelope 89 is evacuated through the exhaust pipe 132 by the evacuator 135 that does not use oil such as an ion pump and a sorption pump to have an atmosphere with sufficiently few organic materials and, then, the exhaust pipe 132 is heated by a burner to be melted and fully sealed.

In order to maintain a pressure after sealing the envelope 89, a getter operation can also be performed. This is an operation for heating a getter disposed in a predetermined position (not shown) in the envelope 89 using resistance heating or high-frequency heating immediately before or after performing the sealing of the envelope 89 to form an evaporated film. The getter usually contains Ba or the like as a main component and maintains the atmosphere in the envelope 89 by an absorbing action of the evaporated film.

In the present invention, other than performing the forming step and the activation step after forming the above-described envelope, it is possible to form an envelope using an electron source substrate to which these steps were applied. As an example of applying the forming step and the activation step to an electron source substrate, the steps can be performed by an apparatus consisting of a substrate stage and a vacuum container as shown in FIG. 10 in addition to a method of placing the electron source substrate inside a vacuum chamber to perform the steps.

Figure 10:
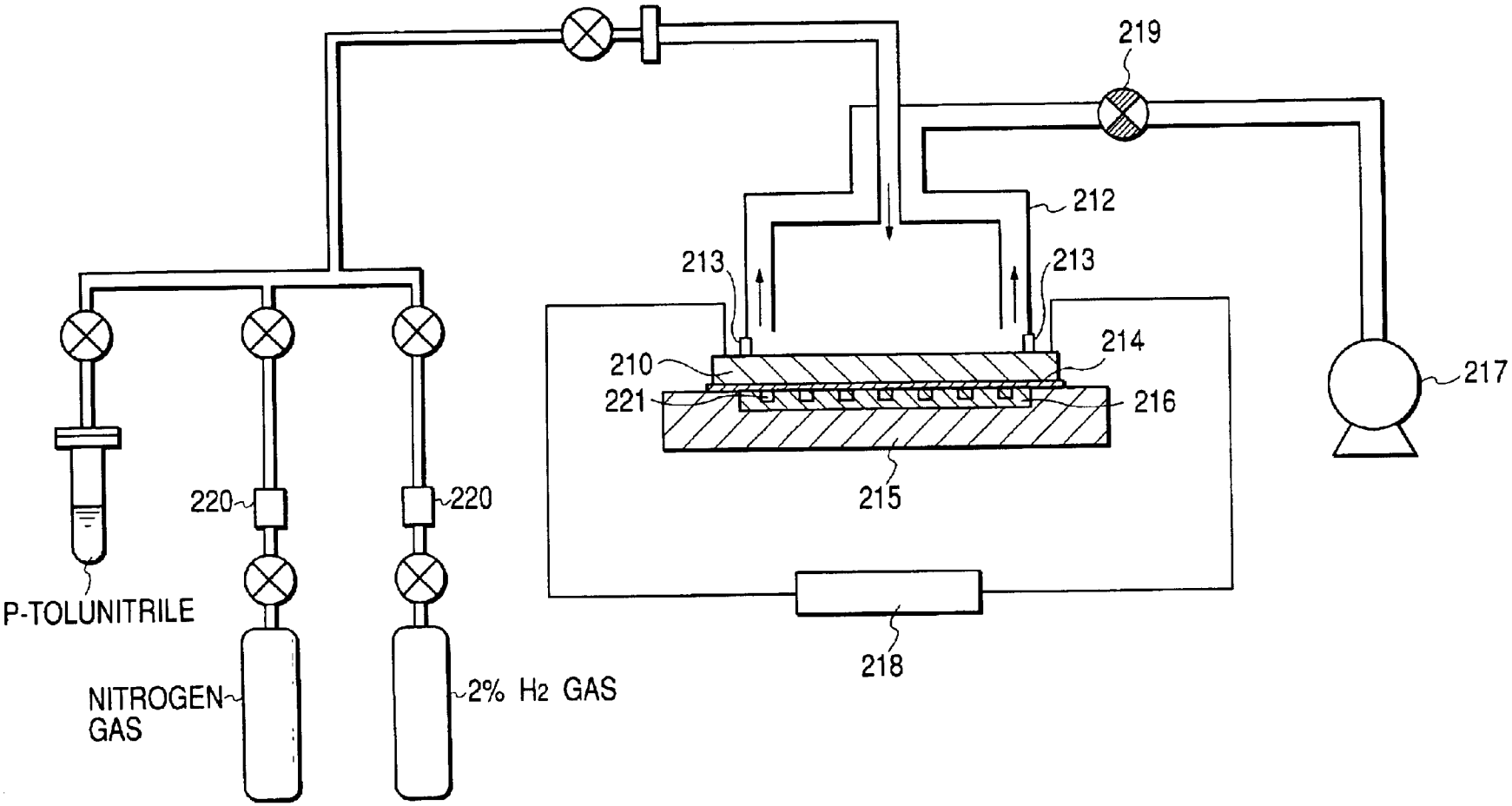
FIG. 10 is a schematic view showing another example of the vacuum apparatus for performing the activation step in accordance with the present invention.

In the apparatus shown in FIG. 10, an electron source substrate 210 on a substrate stage 215 is covered with a vacuum container 212 over its area excluding the peripheral part. The vacuum container 212 takes a hood shape having an internal space and is sealed from the outside by an O ring 213 over its area excluding the peripheral part of the electron source substrate 210.

In evacuating the inside of the vacuum container 212, in order to prevent deformations and damages of the electron source substrate 210 due to a pressure difference between the front and the back of the electron source substrate 210, an electrostatic chuck 216 is provided in the substrate stage 215. Fixing of the substrate by the electrostatic chuck 216 is for applying a voltage to a part between an electrode (not shown) placed in the electrostatic chuck 216 and the electron source substrate 210 to attract the electron source substrate 210 to the substrate stage 215 by an electrostatic force. In order to keep a predetermined potential at a predetermined value in the electron source substrate 210, an electroconductive film such as an ITO film is formed on the back of the substrate. Further, a distance between the electrode (not shown) placed in the electrostatic chuck 216 and the substrate needs to be short for attraction of the substrate by an electrostatic chuck method. Thus, it is desirable to once press the electron source substrate 210 against the electrostatic chuck 216 by another method.

In the apparatus shown in FIG. 10, insides of grooves 221 formed on the surface of the electrostatic chuck 216 are evacuated to press the electron source substrate 210 against the electrostatic chuck 216 by the atmospheric pressure and a high voltage is applied to the electrode (not shown) placed in the electrostatic chuck 216 by a high voltage power source (not shown), whereby the substrate is sufficiently attracted. Thereafter, even if the inside of the vacuum chamber 212 is evacuated, a pressure difference applied to the electron source substrate 210 is cancelled by an electrostatic force by the electrostatic chuck 216. As a result, the substrate is prevented from being deformed or damaged. Moreover, in order to make heat conductivity between the electrostatic chuck 216 and the electron source substrate 210 large, it is desirable to introduce a gas for heat exchange into the grooves 221 that were evacuated once as described above. As the gas, although He is preferable, other gases are also effective.

By introducing the gas for heat exchange, not only the heat conduction between the electron source substrate 210 and the electrostatic chuck 216 is allowed in the parts where the grooves 221 exist but also heat conductivity increases even in the parts where the grooves 221 do not exist compared with the case in which the electron source substrate 210 and the electrostatic chuck 216 simply contact with each other thermally by mechanical contact. As a result, heat conduction as a whole is significantly improved. Consequently, in operations such as forming and activation, heat generated in the electron source substrate 210 easily moves to the substrate stage 215 via the electrostatic chuck 216 to inhibit occurrence of temperature distribution due to temperature increase and local generation of heat in the electron source substrate 210. In addition, temperature of the substrate can be controlled more precisely by providing temperature control means such as a heater and a cooling unit in the substrate stage 215.

In an image-displaying apparatus fabricated by the fabricating method of the present invention described above, electron emission occurs by applying a voltage to each electron-emitting device via the terminals external to a container Dox1 to Doxm and Doy1 to Doyn. Electron beams are accelerated by applying a high voltage to the metal back 85 or a transparent electrode (not shown) via the high voltage terminal Hv. The accelerated electrons collide with the fluorescent film 84 to generate light emission, whereby an image is formed.

The configuration of the image-forming apparatus described above is an example of an image-forming apparatus to which the present invention can be applied, and various alterations are possible based on the technical thought of the present invention.

The image-forming apparatus of the present invention can also be used for an image-forming apparatus and the like as an optical printer constituted by using a photosensitive drum and the like in addition to a display apparatus for television broadcast and a display apparatus for a television conference system, a computer and the like.

Embodiments of the method of fabricating an electron source and an image-forming apparatus of the present invention will be described in detail with reference to the drawings.

[First Embodiment]

Figure 11A:
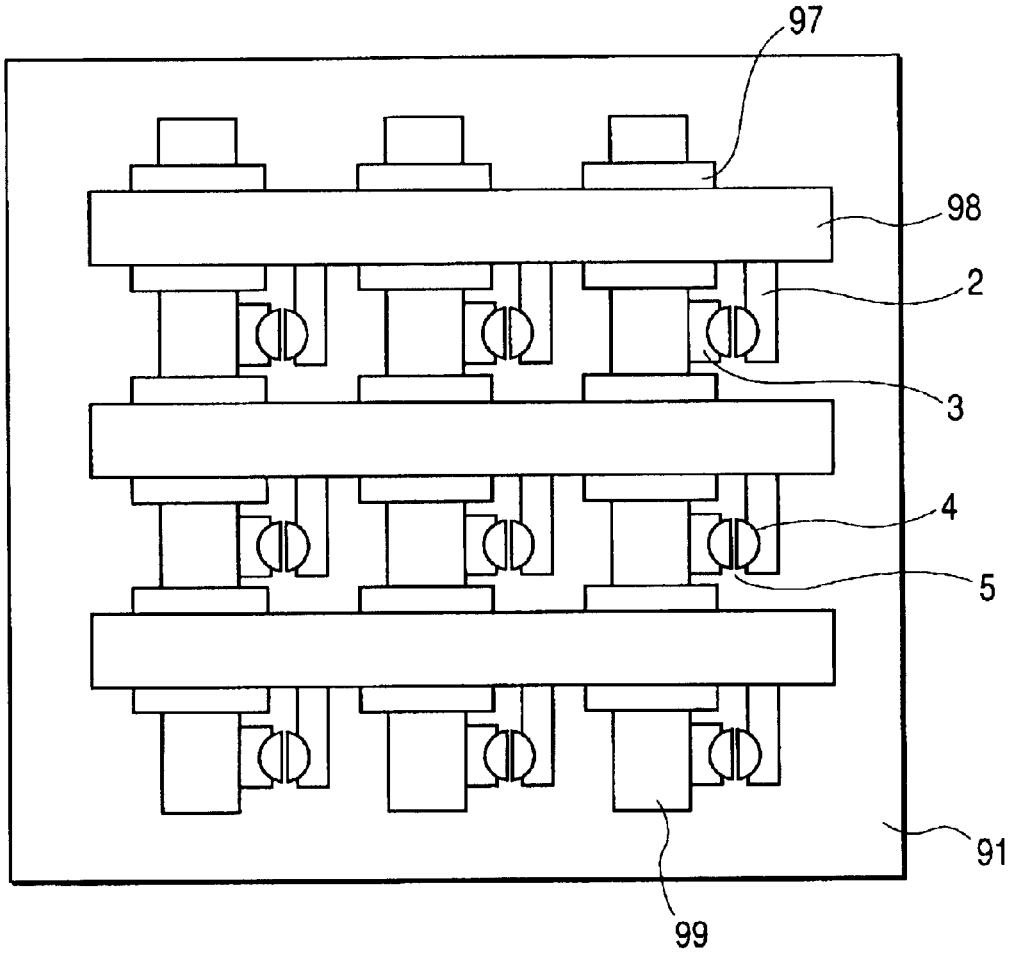
FIG. 11A is a plan view showing a part of an electron source in accordance with an embodiment of the present invention.
Figure 11B:
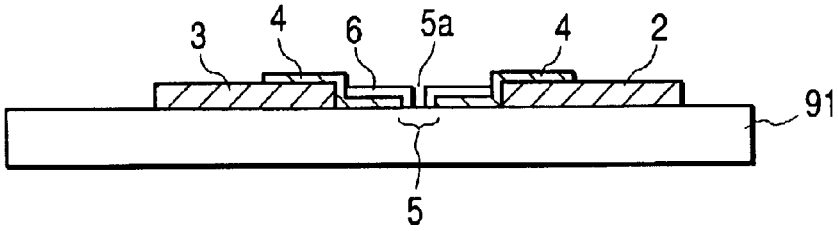
FIG. 11B is a sectional view showing a part of an electron source in accordance with an embodiment of the present invention.

A plan view of a part of an electron source of this embodiment is shown in FIG. 11A. In addition, a sectional view of a part of a device is shown in FIG. 11B. In the figures, reference numeral 91 denotes a substrate, 98 denotes row-directional wirings (200 rows), 99 denotes column-directional wirings (600 columns), 4 denotes electroconductive films, 5 denotes gaps of the electroconductive films 4, 2 and 3 denote device electrodes and 97 denotes interlayer insulating layers.

Next, the method of fabricating an electron source in this embodiment will be specifically described in accordance with an order of steps.

[Step 1]

A plurality of pairs of the device electrode 2 and 3 were fabricated on the cleaned soda lime glass substrate 91 by the offset printing method. An interval L of a device electrode was set to 20 $\mu$m and a width W of a device electrode was set to 125 $\mu$m.

[Step 2]

The column-directional wirings 99 were fabricated by the screen printing method. Next, the interlayer insulating layers 97 with a thickness of 1.0 $\mu$m were fabricated by the screen printing method. Moreover, the row-directional wirings 98 were fabricated by the screen printing method.

[Step 3]

Tetramonoethanolamine-palladium acetic acid ($Pd(NH_2CH_2CH_2OH)_4(CH_3COO)_2$) was solved in an aqueous solution, in which polyvinyl alcohol in a weight concentration of 0.05%, 2-propanol in a weight concentration of 15% and ethylene glycol in a weight concentration of 1% were solved, such that a weight concentration of palladium is approximately 0.15% to obtain a yellow solution.

Liquid drops of the above-described aqueous solution were given to the same parts in each device electrode and between the device electrodes four times by an ink-jet apparatus of the Bubble Jet (registered trademark) system (using a Bubble Jet (registered trademark) printer head BC-01 fabricated by Canon Inc.)

[Step 4]

The specimen fabricated in the step 3 was baked in the atmosphere at 350° C. The electroconductive film 4 of a particulate structure consisting of PdO formed in this way was formed in each part among the above-described plurality of pairs of device electrodes 2 and 3.

Figure 12:
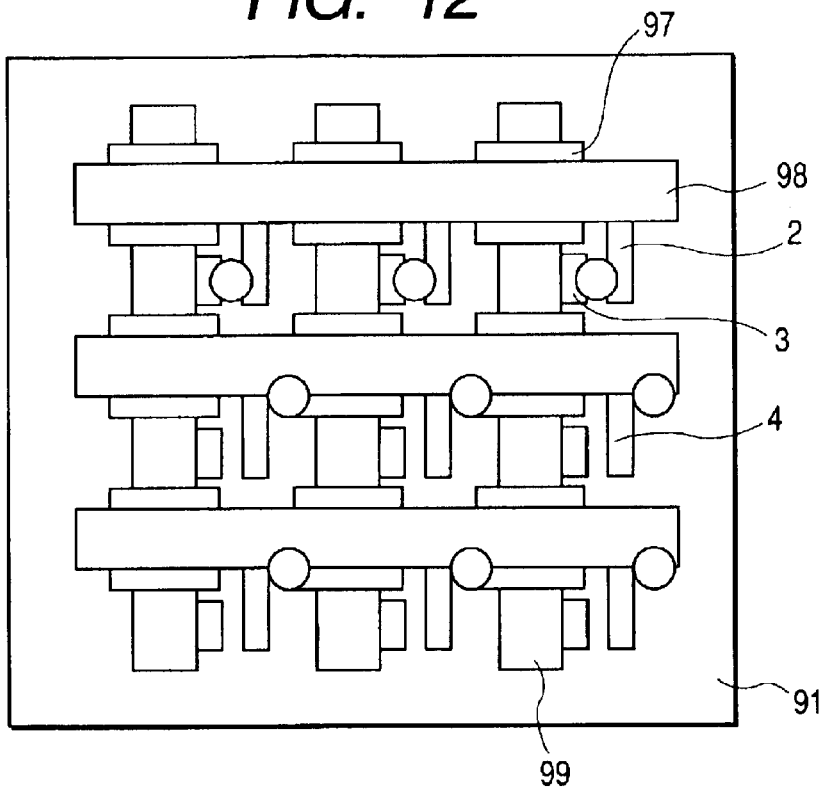
FIG. 12 is a plan view showing a part of an electron source substrate before forming in accordance with an embodiment of the present invention.

By the above-described steps, a plurality of electroconductive films 4, which are matrix-wired by a plurality of row-directional wirings 98 and a plurality of column-directional wirings 99, as shown in FIG. 12 were formed on the substrate 91.

Figure 13:
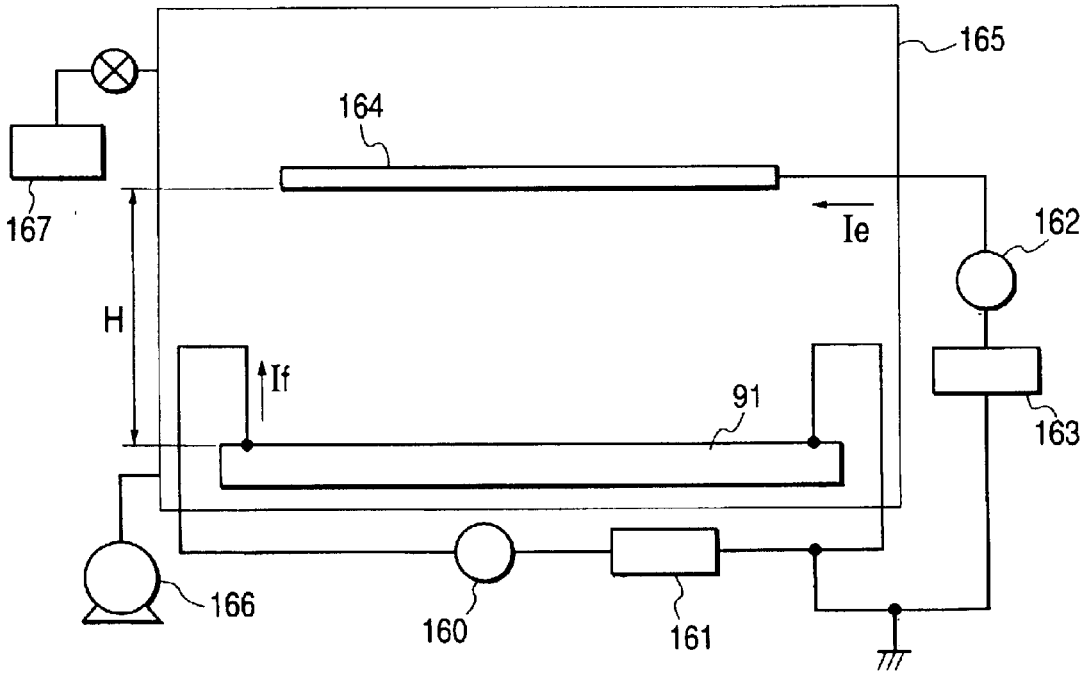
FIG. 13 is a schematic view of a vacuum apparatus used in a first embodiment.

Next, the substrate 91 of FIG. 12 after the step 4 was set in a vacuum operation apparatus of FIG. 13.

The vacuum operation apparatus of FIG. 13 will be described. FIG. 13 is a schematic view showing an example of the vacuum operation apparatus of FIG. 13. This vacuum operation apparatus not only can perform the forming step, the activation step and the stabilization step but also is provided with a function as a measurement evaluation apparatus. Further, in FIG. 16, for convenience of illustration, the row-directional wirings 98, the column-directional wirings 99, the interlayer insulating layers 97, the device electrodes 2 and 3 and the electroconductive films 4, which are formed on the substrate 91, are omitted.

In FIG. 13, reference numeral 165 denotes a vacuum container, 166 denotes an exhaust pump, 161 denotes a power source for applying a voltage Vf to the above-described each electroconductive film 4, 160 denotes an ammeter for measuring a device current If flowing through the electroconductive films 4 between the device electrodes 2 and 3, and 164 denotes an anode electrode for capturing an emission current Ie emitted from an electron-emitting region formed in each electroconductive film 4. Reference numeral 163 denotes a high voltage power source for applying a voltage to the anode electrode 164, and 162 denotes an ammeter for measuring the emission current Ie emitted from the electron-emitting region formed in each electroconductive film 4. As an example, the measurement can be performed by setting a voltage of the anode electrode 164 in the range of 1 kV to 10 kV and setting a distance H between the anode electrode 164 and the substrate 91 in the rage of 2 mm to 8 mm. In addition, reference numeral 167 denotes an organic gas generating source that is used in performing the activation step.

An instrument required for measurement under a vacuum atmosphere such as a not-shown vacuum gauge is provided in the vacuum container 165, whereby measurement and evaluation under a desired vacuum atmosphere can be performed. The exhaust pump 166 is constituted by an ultrahigh vacuum apparatus system consisting of a turbo pump, a dry pump, an ion pump and the like. The entire vacuum operation apparatus described above in which the electron source substrates are arranged can be heated up to 350° C. by a not-shown heater.

[Step 5]

Subsequently, the forming step was applied in the vacuum operation apparatus of FIG. 13. After evacuating the inside of the vacuum container 165 to 10–5 Pa, a voltage was applied to each of the plurality of electroconductive films 4 via the row-directional wirings 98 and the column-directional wirings 99 on the substrate 91 to perform forming. Further, the application of the voltage was performed for each line (row-directional wiring). A fissure was formed in a part of each electroconductive film 4. Here, a voltage waveform of energization forming was a pulse waveform, and a voltage pulse for increasing a pulse peak value in steps of 0 V to 0.1 V was applied. The pulse was a rectangular wave with a pulse width and a pulse interval of the voltage waveform set at 1 msec and 10 msec, respectively. After the energization forming operation, a resistance value of the electroconductive film was set to be 1 MΩ or more.

Figure 14:
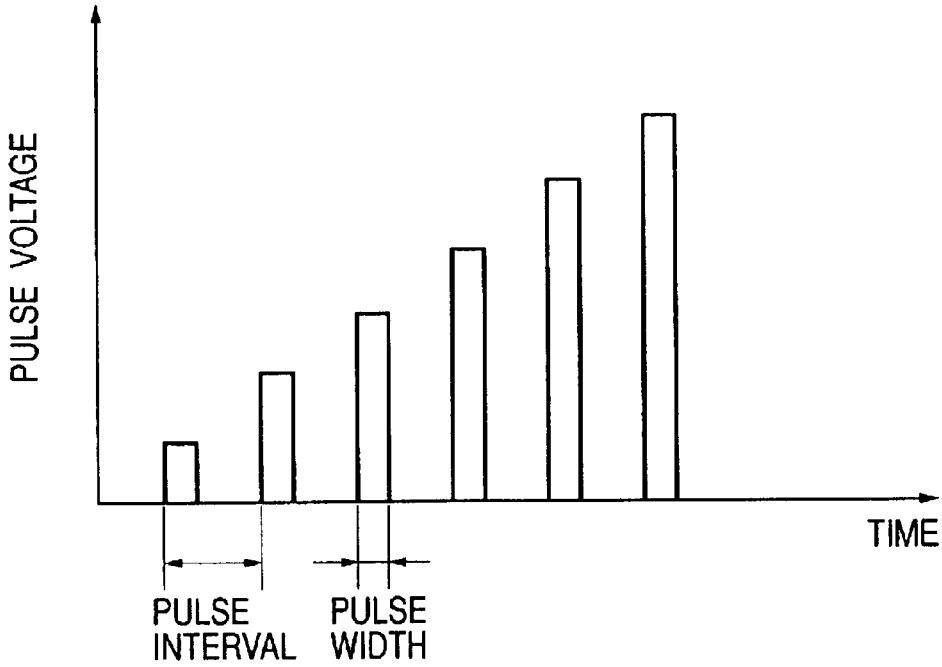
FIG. 14 is a waveform graph of a forming voltage used in the first embodiment.

FIG. 14 shows a forming waveform used in this embodiment. Further, in the device electrodes 2 and 3, a voltage is applied with one electrode as a low potential side and the other electrode as a high potential side.

[Step 6]

After evacuating the inside of the vacuum container 165 to $10^{-5}$ Pa, as the activation step of the first stage, tolunitrile (molecular weight: 117) was introduced up to $1\times10^{-3}$ Pa in a partial pressure, and a voltage was applied to each of the above-described plurality of electroconductive films 4 via the row-directional wirings 98 and the column-directional wirings 99 on the substrate 91. This application of a voltage was performed by a line sequential scanning for each line (row-directional wiring). A pulse of a rectangular wave with a pulse peak value fixed at 15 V, a pulse width set to 1 msec and a pulse interval set to 10 msec was applied. Further, a voltage was applied to each line (row-directional wiring) for one minute. The activation step of the first stage was finished in this way.

Next, after evacuating the inside of the vacuum container 165 to $10^{-5}$ Pa, as the activation step of the second stage, methane (molecular weight: 16) was introduced up to $1\times10^{-1}$ Pa in a partial pressure and hydrogen was further introduced to have an overall pressure of $2\times10^{-1}$ Pa. A voltage was applied to each line (row-directional wiring) for approximately 10 minutes as in the activation step of the first stage and, when a device current in each line reached 0.8 mA in average, the activation step of the second stage is finished.

Figure 15:
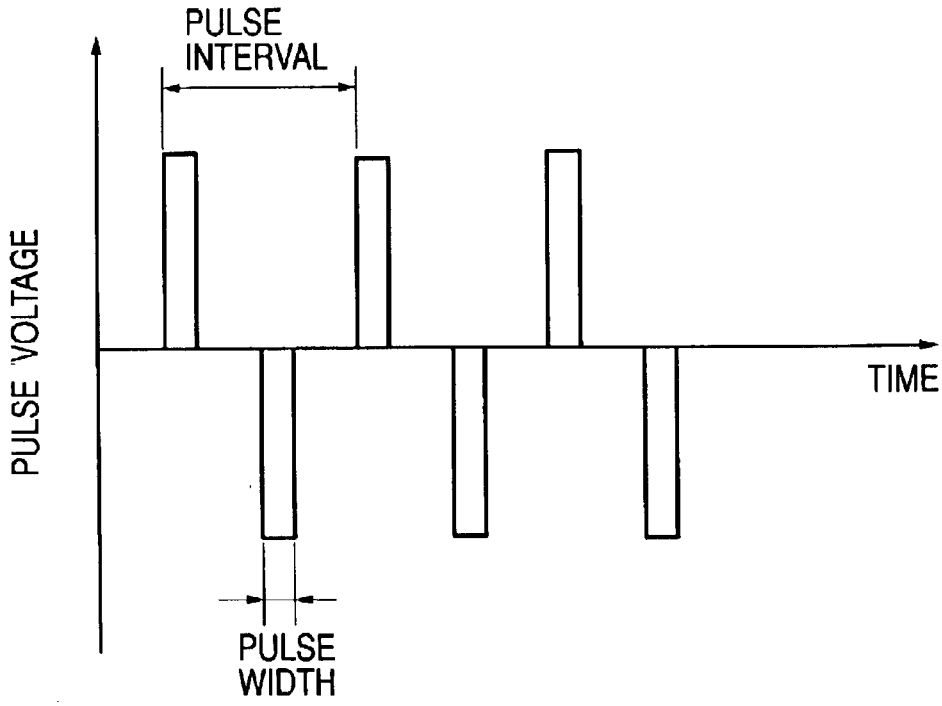
FIG. 15 is a waveform graph of an activation voltage used in the first embodiment.
Figure 16:
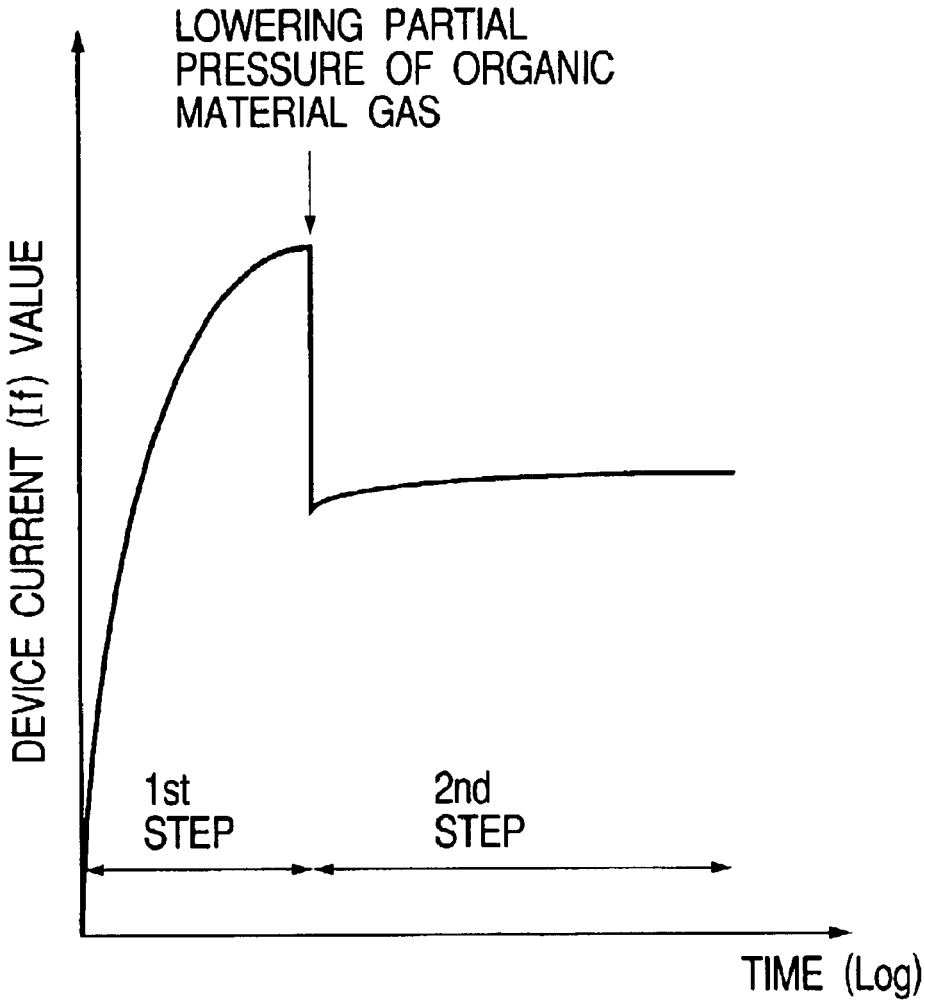
FIG. 16 is a graph showing an increase characteristic of a device electric current in an activation step of the first embodiment.

FIG. 15 shows a pulse waveform that is used in the activation steps of the first and the second stages described above. In this embodiment, a voltage was applied to the device electrodes 2 and 3 such that low and high potentials are alternated for each pulse interval. Here, changes over time of a device current in the activation step of this embodiment are shown in FIG. 16. It is seen that, although considerable increase of a device current is seen in the activation step of the first stage, increase of a device current is little in the activation step of the second stage.

The carbon film 4*a* was formed on each electroconductive film 4 by the above steps as shown in FIGS. 1A and 1B.

[Step 7]

Subsequently, the stabilization step is performed. The stabilization step is a step for exhausting an organic gas existing in the atmosphere in a vacuum container, or the like, and inhibiting deposition of carbon or carbon compound to stabilize the device current If and the emission current Ie. More specifically, the entire vacuum container was heated up to 250° C. to exhaust organic material molecules absorbed in the internal surface of the vacuum container and the substrate 91. At this point, a degree of vacuum was $1\times10^{-6}$ Pa.

The electron source of this embodiment shown in FIGS. 11A and 11B was fabricated by the above steps.

Thereafter, as a result of measuring a characteristic of each electron-emitting device at this degree of vacuum, it was found that the device current If=0.8 mA and the emission current Ie=2.3 μA in average. As a result of dividing a dispersion value by an average value of the characteristic of each electron-emitting device in order to evaluate uniformity of the characteristics, it was found that a value of the device current If was 15% and a value of the emission current Ie was 20%.

COMPARATIVE EXAMPLE 1

The activation step in the step 6 of the first embodiment was applied to the substrate 91, for which the steps 1 to 5 of the first embodiment were finished, by setting the partial pressure of toluene (molecular weight: 92) to $1\times10^{-4}$ Pa and applying a voltage to each of the plurality of electroconductive films 4 via the row-directional wirings 98 and the column-directional wirings 99 on the substrate 91. This application of a voltage was performed by a line sequential scanning for each line (row-directional wiring). The voltage was applied by applying a pulse of a rectangular wave with a pulse peak value fixed at 15 V, a pulse width set to 1 msec and a pulse interval set to 10 msec, and was applied to each line (row-directional wiring) for sixty minutes. Thereafter, the electron source was fabricated in the same manner as the first embodiment except that the activation step of the second stage was not performed.

As a result of dividing a dispersion value by an average value of the characteristic of each electron-emitting device as in the first embodiment for evaluation of uniformity of the characteristics, it was found that a value of the device current If was 25% and a value of the emission current Ie was 30%.

COMPARATIVE EXAMPLE 2

The activation step in the step 6 of the first embodiment was applied to the substrate 91, for which the steps 1 to 5 of the first embodiment were finished, by setting the partial pressure of toluene (molecular weight: 92) at $1\times10^{-4}$ Pa and applying a voltage to each of the plurality of electroconductive films 4 via the row-directional wirings 98 and the column-directional wirings 99 on the substrate 91. This application of a voltage was performed by a line sequential scanning for each line (row-directional wiring). The voltage was applied by applying a pulse of a rectangular wave with a pulse peak value fixed at 15 V, a pulse width set at 1 msec and a pulse interval set at 10 msec, and was applied to each line (row-directional wiring) for sixty minutes. Thereafter, the electron source was fabricated in the same manner as in the first embodiment except that the activation step of the second stage was not performed.

As a result of dividing a dispersion value by an average value of the characteristic of each electron-emitting device as in the first embodiment for evaluation of uniformity of the characteristics, it was found that a value of the device current If was 30% and a value of the emission current Ie was 35%.

[Second Embodiment]

Figure 17:
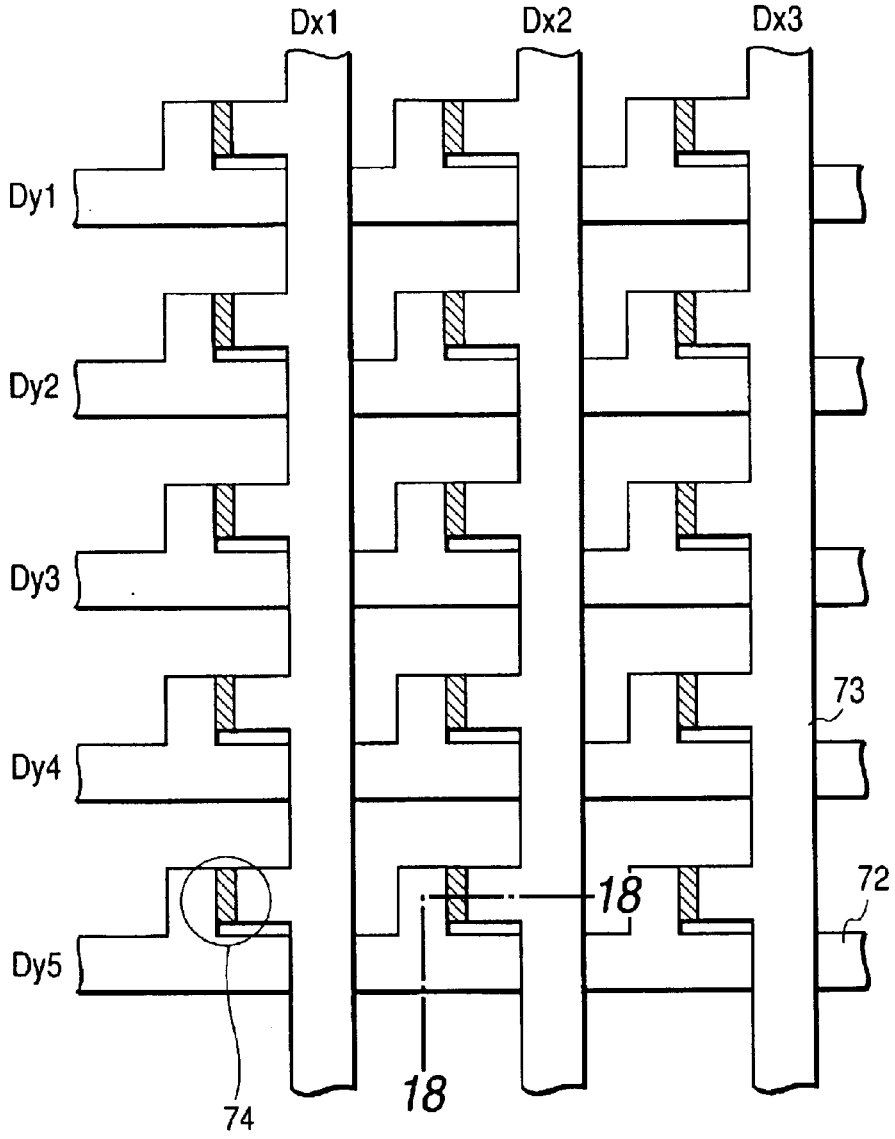
FIG. 17 is a view showing a part of an electron source in accordance with a second embodiment.
Figure 18:
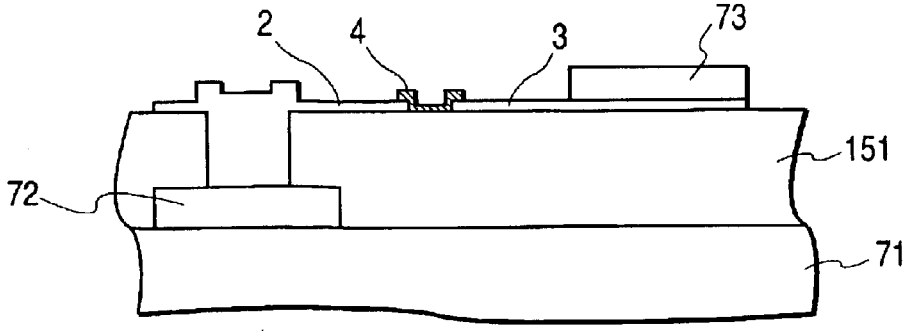
FIG. 18 is a partial sectional view of the electron source of FIG. 17.

In this embodiment, an image-forming apparatus to be used for display will be described. FIG. 6 shows a basic configuration of the image-forming apparatus in this embodiment. FIG. 7A shows a fluorescent film. A plan view of a part of an electron source is shown in FIG. 17. In addition, a sectional view taken along the line 18—18 in FIG. 17 is shown in FIG. 18. Note that the same symbols denote the same parts in FIGS. 17 and 18. Here, reference numeral 71 denotes a substrate, 72 denotes column-directional wirings (also referred to as lower wirings) connected to the Doy1 to Doyn terminals of FIG. 6, 73 denotes row-directional wirings (also referred to as upper wirings) connected to Dox1 to Doxm terminals of FIG. 6, 74 denotes electron-emitting devices, 4 denotes an electroconductive film, 2 and 3 denote device electrodes and 151 denotes an interlayer insulating layer.

In the electron source of this embodiment, six hundred electron-emitting devices are formed in the row direction and two hundred electron-emitting devices are formed in the column direction. Next, a fabricating method is specifically described in accordance with an order of steps with reference to FIGS. 19A through 19D to 23.

[Step a]

Figure 19A:
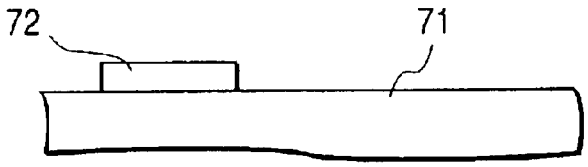
FIGS. 19A, 19B, 19C and 19D are sectional views for illustrating a fabricating step of the electron source of the second embodiment.

Cr with a thickness of 5 nm and Au with a thickness of 600 nm were sequentially laminated by vacuum evaporation on the substrate 71 in which a silicon oxide film with a thickness of 0.5 mm was formed by the sputtering method on a soda lime glass (thickness of 2.8 mm). Thereafter, a photoresist (AZ1370 fabricated by Hoechst) was rotationally applied by a spinner and baked and, then, a photomask image was exposed and developed to form a resist pattern of the lower wiring 72, and an Au/Cr deposit film was wet-etched to form the lower wiring 72 of a desired shape on the substrate 71 (FIG. 19A).

[Step b]

Figure 19B:
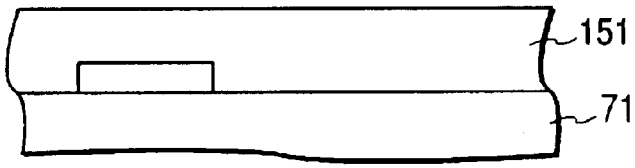

Next, the interlayer insulating layer 151 consisting of a silicon oxide film with a thickness of 1.0 mm was deposited by the RF sputtering method (FIG. 19B).

[Step c]

Figure 19C:
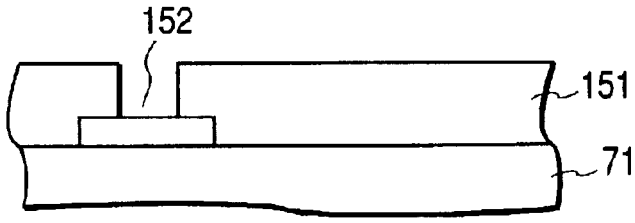

A photoresist pattern for forming a contact hole 152 was made on the silicon oxide film deposited in the step b and the contact hole 152 was formed by etching the interlayer insulating layer 151 with this photoresist pattern as a mask (FIG. 19C). The etching was performed by the RIE (Reactive Ion Etching) method using $CF_4$ and $H_2$ gases.

[Step d]

Figure 19D:
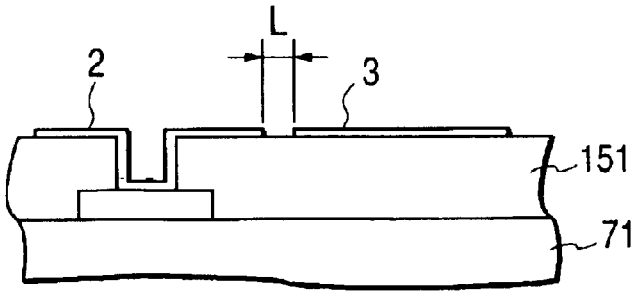

Thereafter, a pattern having openings corresponding to the device electrodes 2 and 3 were formed on a photoresist (RD-2000N-41 fabricated by Hitachi Chemical Co., Ltd.) and Ti with a thickness of 5 nm and Ni with a thickness of 100 nm were sequentially deposited thereon by the vacuum evaporation method. The photoresist pattern was dissolved by an organic solvent to lift off the Ni/Ti deposit film. The device electrodes 2 and 3 were formed by setting the device electrode interval L to 5 $\mu$m and the width W of the device electrode to 300 $\mu$m (FIG. 19D).

[Step e]

Figure 20E:
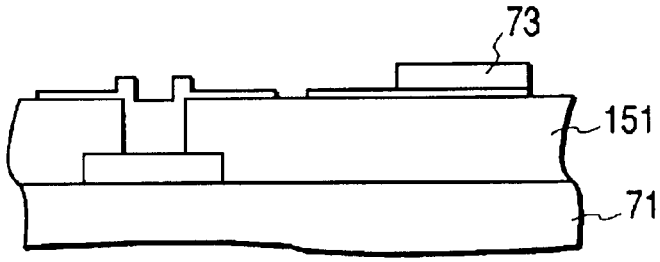
FIGS. 20E, 20F and 20G are sectional views for illustrating the fabricating step of the electron source of the second embodiment.

After forming the photoresist pattern having the openings corresponding to the upper wiring 73, Ti with a thickness of 5 nm and Au with a thickness of 500 nm were sequentially deposited by vacuum evaporation and unnecessary parts were removed by lift-off to form the upper wiring 73 of a desired shape (FIG. 20E)

[Step f]

Figure 20F:
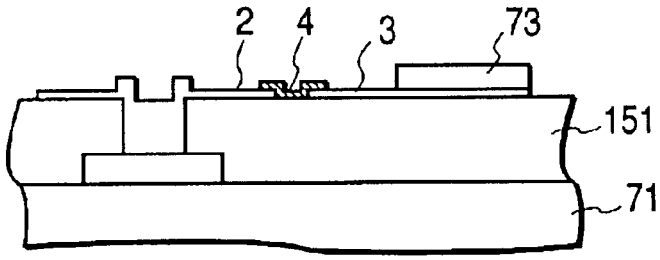

A Cr film with a film thickness of 100 nm was deposited and patterned by vacuum evaporation to form a pattern having openings corresponding to the electroconductive film 4. Then, organic Pd (ccp4230 fabricated by Okuno Chemical Industries Co., Ltd.) was rotationally applied thereon by a spinner and heating/baking operation was applied at the temperature of 300° C. for ten minutes. In an electroconductive film consisting of PdO particulates that was formed in this way, a film thickness was 10 nm and a sheet resistance value was $5\times10^4$ Ω/□. Thereafter, the Cr film and the electroconductive film after baking were etched by an acid etchant to form the electroconductive film 4 of a desired shape (FIG. 20F).

[Step g]

Figure 20G:
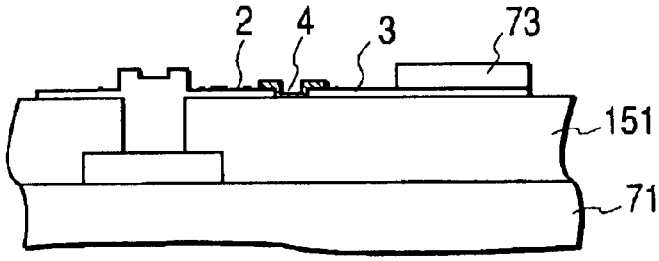

A pattern for applying a resist to parts other than the contact hole 152 was formed and Ti with a thickness of 5 nm and Au with a thickness of 500 nm were sequentially deposited thereon by vacuum evaporation. By removing unnecessary parts by lift-off, the contact hole 152 was filled up (FIG. 20G).

By the above steps, an electron source substrate was formed which had the plurality of column-directional wirings (lower wirings) 72, the plurality of row-directional wirings (upper wirings) 73, the interlayer insulting layer 151 for insulating the parts between both the wirings, and the plurality of electroconductive films 4 that were matrix-wired via the device electrodes 2 and 3 by both the wirings on the substrate 71.

Figure 21:
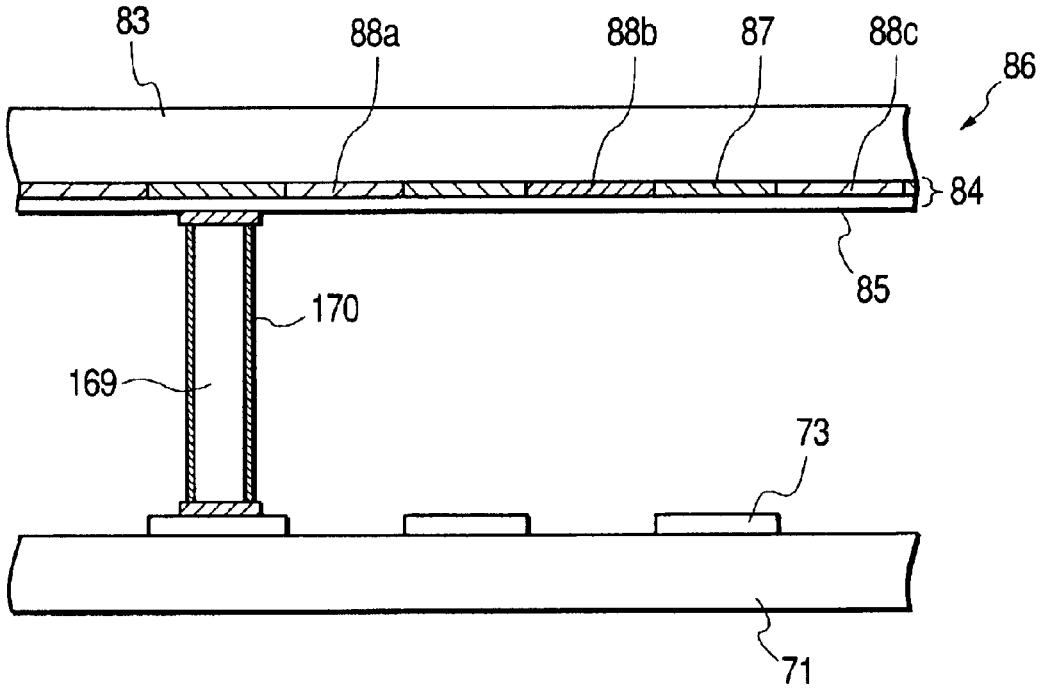
FIG. 21 is a partial sectional view of an image-forming apparatus of the second embodiment.

Next, an example in which a display apparatus was constituted using the electron source substrate fabricated as described above will be described with reference to FIGS. 6 and 21. FIG. 21 is a schematic view of a cross section of the envelope 89 in the row wiring direction of FIG. 6.

An electroconductive frit paste was applied onto the upper wiring 73 on the electron source substrate 71 by a dispenser and baked in a state in which one end of the spacer 169 is disposed thereon to erect the spacer 169 on the electron source substrate. Next, the electroconductive frit paste was applied to the other end of the spacer 169 using the dispenser and, then, the other end of the spacer 169 was disposed to coincide with the black electroconductive material (black stripe) 87 on the face plate 86 side and baked with the support frame 82, to which the frit glass was applied, at the temperature of 420° C. for 10 minutes or more. In this way, the envelope 89 shown in FIG. 6 was fabricated.

A electroconductive frit paste containing soda lime glass balls, whose surfaces were applied with Au plating, as a filler was used for fixing the spacer 169 to the upper wiring 73 and the face plate 86. In this case, an average particle diameter of the soda lime ball was set at approximately 8 $\mu$m. In addition, the electroconductive layer on the filler surface was fabricated by using the electroless plating method and forming an Ni film of approximately 0.1 $\mu$m as a base and an Au film of 0.04 $\mu$m on the Ni film. The electroconductive frit paste was adjusted by mixing this electroconductive filler in frit glass powder at a ratio of 30% by weight and further adding a binder.

In addition, the spacer 169 uses soda lime glass processed in a width of 0.6 mm, a length of 75 mm and a height of 4 mm by the etching method and is provided with a semi-electroconductive film 170 consisting of a nickel oxide film thereon. The nickel oxide film was formed by using a sputtering apparatus to perform sputtering in an argon/oxygen mixed atmosphere using nickel oxide as a target. Further, the sputtering was performed at the substrate temperature of 250° C.

In addition, two spacers are arranged side by side on one upper wiring and one spacer was arranged for each ten lines such that a pixel region was divided into twenty parts in the upper wiring direction by the spacers 169.

As the fluorescent film 84 on the face plate, color phosphors 88*a*, 88*b* and 88*c* of a black stripe arrangement constituted by the black electroconductive material 87 and the phosphor 88 were used. First, black stripes were formed and a phosphor of each color was applied to gaps among the black stripes to fabricate the fluorescent film 84. As a method of applying a phosphor to a glass substrate, the slurry method was used. In addition, the metal back 85 was provided on the inner side of the fluorescent film 84. The metal back 85 was fabricated by performing smoothing operation of the surface on the inner side of a fluorescent film after fabricating the fluorescent film and, then, depositing Al by vacuum evaporation.

In performing the sealing of the envelope 89, since it was necessary to associate a phosphor of each color with an electron-emitting device in the case of a color fluorescent film, sufficient positioning was performed. In addition, both the ends of the upper wirings and the ends of the lower wirings on the electron source substrate were electrically connected to a power source (not shown) installed in the outside by a flat cable.

The envelope 89 completed as described above was connected to the vacuum apparatus shown in FIG. 8, which is evacuated by a magnetic levitation type turbo molecular pump, via the exhaust pipe to perform the forming step and the subsequent steps as described below.

After evacuating the inside of the envelope 89 to $10^{-2}$ Pa, a rectangular wave with a pulse width of 1 ms was sequentially applied to the upper wirings from the power source arranged on the outside at a scroll frequency of 4.2 Hz. A voltage value was set at 12 V. Further, the lower wirings were grounded. A mixed gas of hydrogen and nitrogen (2% hydrogen and 98% nitrogen) was introduced into the chamber 133 of the vacuum apparatus shown in FIG. 8 and the pressure was kept at 1000 Pa. The gas introduction was controlled by the mass-flow controller 139 and, on the other hand, a flow rate of exhaust from the chamber 133 was controlled by the evacuator 135 and a conductance valve for controlling a flow rate.

When the energization operation was performed for ten minutes, a value of an electric current flowing through the electroconductive film fell to approximately zero. Then, the voltage application was stopped and the mixed gas of hydrogen and nitrogen in the chamber 133 was exhausted to complete the forming and form fissures in the plurality of electroconductive films on the substrate 71, whereby an electron-emitting region was fabricated.

Next, the activation step was performed in the following steps of two stages, namely the first and the second steps.

<First Activation Step>

Figure 22:
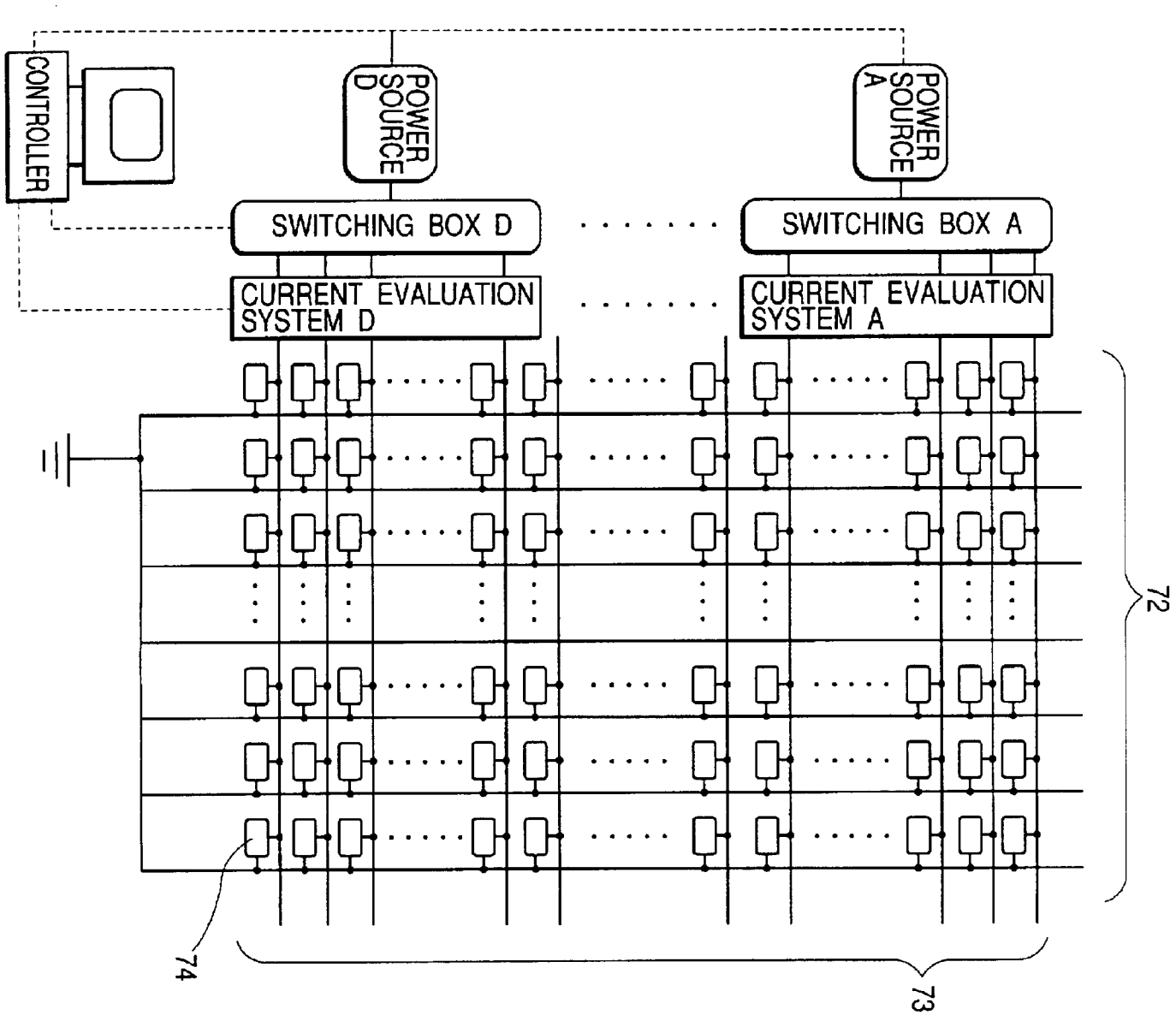
FIG. 22 is a schematic view showing a method of connecting wirings for an activation step of the second embodiment.

After evacuating the inside of the envelope 89 to $10^{-4}$ Pa, benzonitrile (molecular weight: 103) was introduced in the envelope 89 to $5\times10^{-3}$ Pa in a partial pressure via the vacuum chamber 133 of the above-described vacuum apparatus. FIG. 22 shows connection between terminals external to a container of an envelope and a power source for applying a voltage in the activation step. Terminals external to a container Doy1 to Doyn (n=600) were commonly grounded.

On the other hand, terminals external to a container Dox1 to Dox50, terminals external to a container Dox51 to Dox100, terminals external to a container Dox101 to Dox150 and terminals external to a container Dox151 to Dox200 were connected to power sources A, B, C and D via switching boxes A, B, C and D, respectively. Current evaluation systems A, B, C and D constituted by ammeters for measuring an electric current flowing through the wirings were connected between each switching box and each terminal external to a container.

The power sources A to D were controlled by a synchronizing signal from a controller, phases of an activation waveform were aligned and each switching box and each power source were synchronized, whereby each ten lines were selected among each line block of fifty lines consisting of Dox1 to Dox50, Dox51 to Dox100, Dox101 to Dox150 and Dox151 to Dox200. Then, a voltage was applied to these ten lines in time division (scroll).

Consequently, a voltage was simultaneously applied to the four upper wirings 73 of the electron source substrate in the envelope and the first activation step was applied to the electroconductive film 4 connected to each upper wiring 73.

As conditions for applying a voltage in the activation step, a bipolar rectangular wave with a peak value of ±14 V, a pulse width of 1 msec and a pulse interval of 10 msec (FIG. 4B) was used.

A value of electric current flowing to each upper wiring during the scroll of the ten lines was evaluated by the current evaluation systems and, when this electric current value exceeded 1 A, the switching boxes were controlled to stop the application of a voltage to the corresponding upper wirings. This step was repeated five times and all the electroconductive films 4 were activated.

<Second Activation Step>

After evacuating the inside of the envelope 89 to $10^{-4}$ Pa, methane (molecular weight: 16) was introduced in the envelope 89 up to $2\times10^{-1}$ Pa in a partial pressure. As in the first activation step, a voltage was applied to ten lines in time division and a voltage was applied to the part between the device electrodes 2 and 3 connected to the corresponding electroconductive film 4 to perform the second activation step. A waveform of the applied voltage in the second activation step was the same as in the first activation step, and activation time was uniformly thirty minutes. 1A device current flowing to the upper wirings at the end of the second activation step was in the range of 800 mA to 1 A. Further, the carbon film 4*a* was formed on each electroconductive film 4 as shown in FIGS. 1A and 1B.

Lastly, as the stabilization step, baking was performed with the pressure of approximately $1.33\times10^{-6}$ Pa for ten hours at the temperature of 150° C. and, then, a not-shown exhaust pipe was heated by a gas burner to be welded and the envelope 89 was sealed.

In the image-forming apparatus of this embodiment (FIG. 6) that was completed as described above, a scanning signal and a modulation signal were applied to each electron-emitting device from not-shown signal generating means, respectively, through the terminals external to a container Dox1 to Doxm (m=200) and Doy1 to Doyn (n=600), whereby the electron-emitting device was caused to emit electrons. In addition, a high voltage of 6 kV or more was applied to the metal back 85 through the high voltage terminal Hv, and electron beams were accelerated and caused to collide with the fluorescent film 84 to cause excitation and light emission, whereby an image was displayed.

In addition, when a pulse voltage was applied from each of the row-directional wirings and the column-directional wirings to measure dispersion of an electron-emitting characteristic (the device current If and the emission current Ie) of each electron-emitting device in the image-forming apparatus, it was 11% in If and 15% in Ie. Here, the dispersion was a value found by dividing a dispersion value of If and Ie values of each device by an average value of them.

[Third Embodiment]

Figure 23:
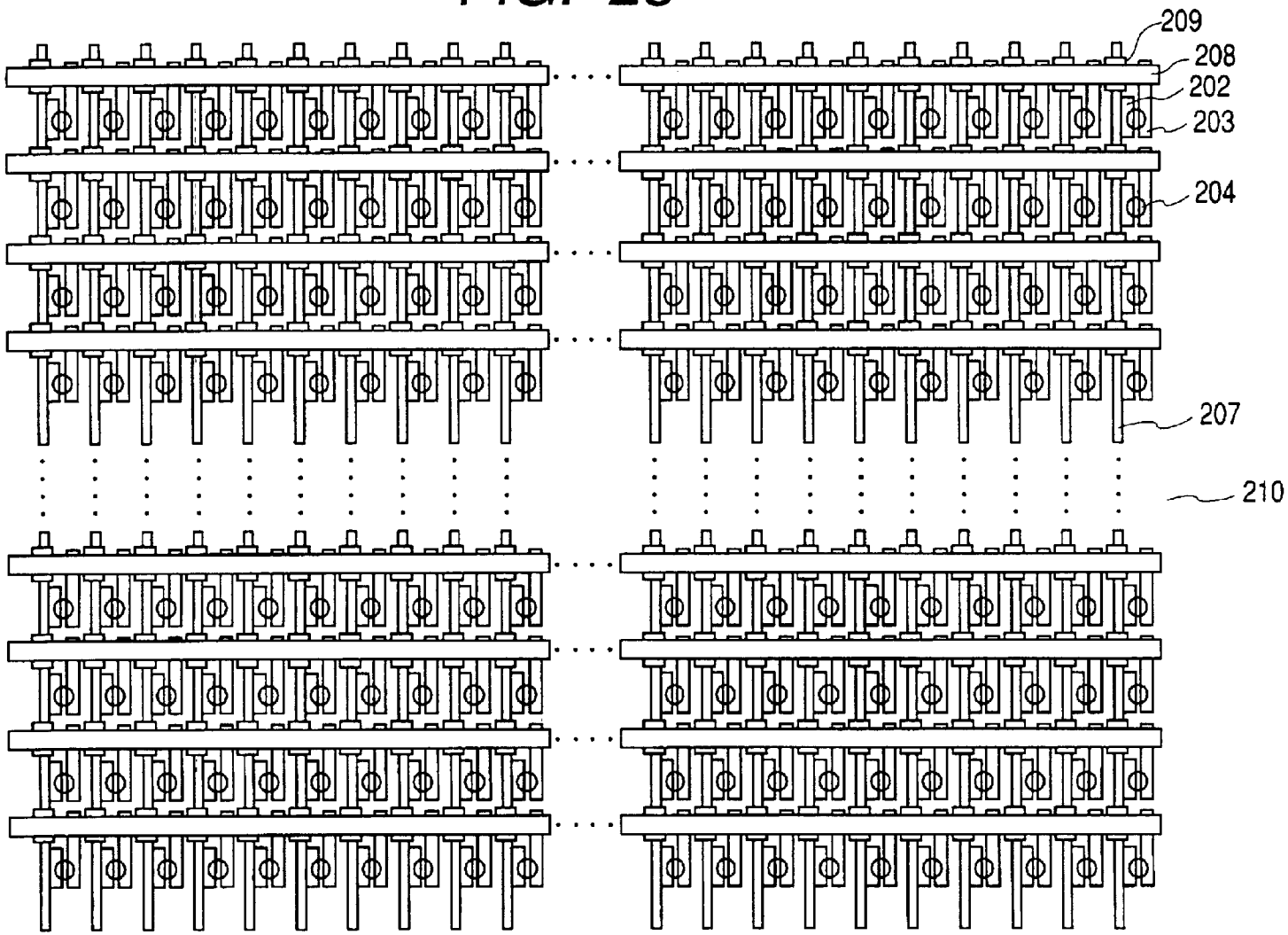
FIG. 23 is a view showing a part of an electron source in accordance with a third embodiment.

The electron source substrate 210 of the configuration shown in FIG. 23 was fabricated as follows.

First, a PT paste was printed on a glass substrate (with a size of 350 mm×300 mm and a thickness of 2.8 mm) by the offset printing method, in which an $SiO_2$ layer was formed, and was heated and baked to form device electrodes 202 and 203 with a thickness of 50 nm.

Figure 24:
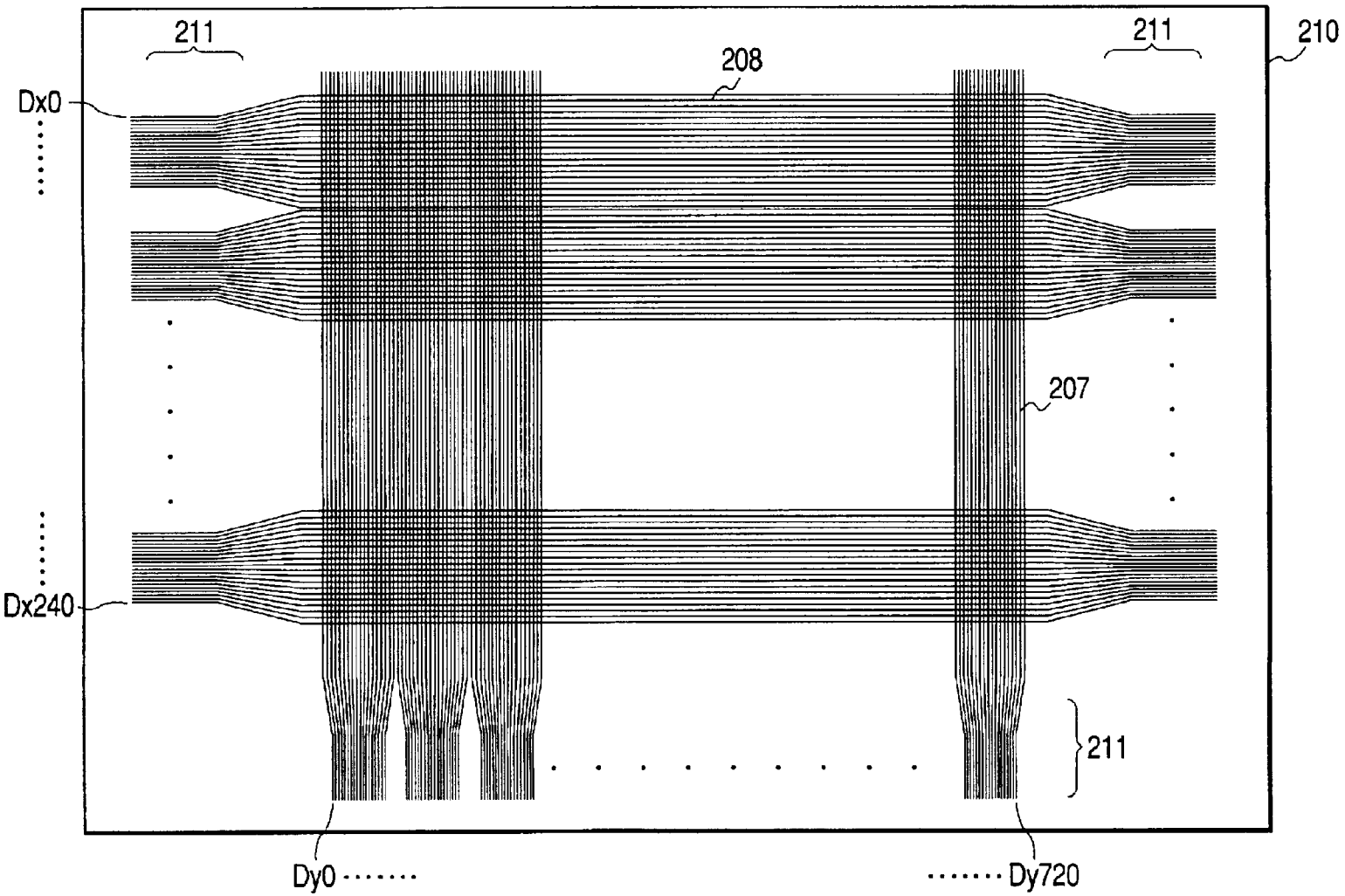
FIG. 24 is a schematic view showing an extraction pattern of a wiring of an electron source substrate.

Next, an AG paste was printed by the screen printing method and heated and baked to form seven hundred twenty column-directional wirings (lower wirings) 207 and two hundred forty row-directional wirings 208. Further, an insulating paste was printed by the screen printing method at the intersections of the column-directional wirings 207 and the row-directional wirings 208 and heated and baked to form an insulating layer 209. In addition, in order to electrically connect the column-directional wirings 207 and the row-directional wirings 208 with power sources in the outside, wiring extraction patterns 211 were formed at the end of the electron source substrate 210 by the screen printing method as shown in FIG. 24. Moreover, in order to hold the substrate by an electrostatic chuck discussed below, an ITO film (100 nm thickness) was formed by the sputtering method on the back of the glass substrate.

Next, palladium complex solution was dropped on the parts among the device electrodes 202 and 203 using an injection apparatus of the Bubble Jet (registered trademark) method and heated for thirty minutes at the temperature of 35020 C. to form electroconductive films 204 consisting of particulates of palladium oxide. The film thickness of the electroconductive film 204 was 20 nm. In this way, an electron source substrate 210 was fabricated on which the plurality of electroconductive films 204 were matrix-wired by the plurality of row-directional wirings 208 and the plurality of column-directional wirings 207.

The following forming step and activation step were applied to the electron source substrate 210 fabricated as described above using the evacuator as shown in FIG. 10.

First, as shown in FIG. 10, the electron source substrate 210 installed on the stage 215 was covered by the vacuum container 212 in the area excluding the extraction pattern 211 (see FIG. 24) provided on the electron source substrate 210. The O ring 213 was disposed between the electron source substrate 210 and the vacuum container 212 such that the O ring 213 surrounded a device part area created on the electron source substrate. The device part area is sealed against the outside world. The stage 215 includes the electrostatic chuck 216 for fixing the electron source substrate 210 on the stage. A voltage of 1 kV was applied to the part between the ITO film 214 formed on the back of the electron source substrate 210 and the electrode in the electrostatic chuck to fasten the electron source substrate 210.

Next, the inside of the vacuum container was evacuated by a magnetic levitation type turbo molecular pump 217 to perform the forming step and the subsequent steps as follows.

<Forming Step>

First, the inside of the vacuum container was evacuated to $10^{-4}$ Pa. In addition, application of a voltage to the upper wirings and the lower wirings was performed by causing contact pins to contact the extraction pattern 211 (see FIG. 24) of each wiring sticking out of the vacuum container. Here, not-shown contact pins Cox1 to Coxm (m=240) were caused to contact the extraction patterns 211 of the upper wirings 208. On the other hand, not-shown contact pins Coy1 to Coyn (n=720) were caused to contact the extraction patterns 211 of the lower wirings 207. A rectangular wave with a pulse width of 1 ms was sequentially applied to the upper wirings 208 at a scroll frequency of 4.2 Hz from a power source 218 installed outside. The voltage value was set at 12 V. In addition, the lower wirings were grounded. A mixed gas of hydrogen and nitrogen (2% hydrogen and 98% nitrogen) was introduced into the vacuum container and the pressure was kept at 1000 Pa. The gas introduction was controlled by a mass-flow controller 220 and, on the other hand, a flow rate of exhaust from the vacuum container was controlled by an evacuator 135 a conductance valve 219 for controlling a flow rate. When energization operation was performed for ten minutes, a value of electric current flowing through the electroconductive film 204 fell to approximately zero. Then, the voltage application was stopped and the mixed gas of hydrogen and nitrogen in the vacuum container was exhausted to complete the forming and form fissures in all the electroconductive films 204 on the electron source substrate 210, whereby an electron-emitting region was fabricated.

Next, the activation step was performed in the following steps of two stages, namely the first and the second steps.

<First Activation Step>

Figure 25:
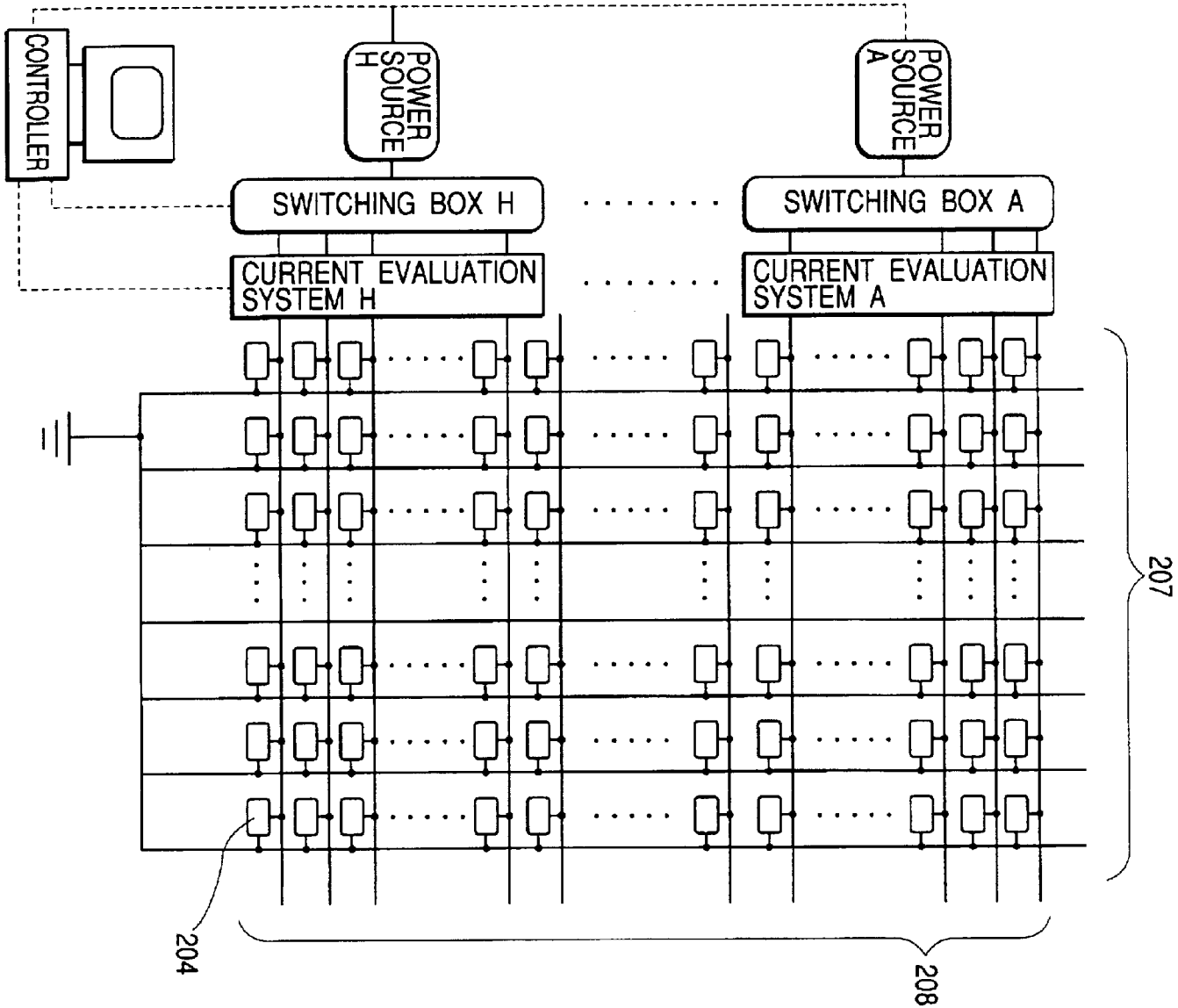
FIG. 25 is a schematic view showing a method of connecting wirings for an activation step of the third embodiment.

After evacuating the inside of the vacuum container 212 to $10^{-5}$ Pa, tolunitrile (molecular weight: 117) was introduced in the vacuum container 212 up to $1\times10^{-3}$ Pa in a partial pressure. FIG. 25 shows connection between the extraction patterns 211 of the electron source substrate 210 used in the activation step of this embodiment and power sources for applying a voltage. First, the not-shown contact pins Coy1 to Coyn (n=720) contacting the lower wirings 207 were commonly grounded. On the other hand, the not-shown contact pins Cox1 to Cox240 contacting the upper wirings 208 were partitioned into eight blocks of thirty pins per block and each block of upper wirings 208 was connected to power sources A to H via switching boxes A to H, respectively. Further, current evaluation systems A to H configured by ammeters for measuring an electric current flowing through the wirings were connected to the part between each switching box and each contact pin.

The power sources A to H were controlled by a synchronizing signal from a controller, phases of an activation waveform were aligned and each switching box and each power source were synchronized, whereby each ten lines were selected among line blocks such that the two hundred forty upper wirings 208 were partitioned into blocks of thirty lines per block. Then, a voltage was applied to these ten lines in time division (scroll). Consequently, a voltage was simultaneously applied to the eight upper wirings of the electron source substrate 210 and the first activation step was applied to the electroconductive film 204 connected to each upper wiring. Further, as conditions for applying a voltage in the first activation step, a bipolar rectangular wave with a peak value of ±14 V, a pulse width of 1 msec and a pulse interval of 10 msec (FIG. 4B) was used. A value of electric current flowing to each upper wiring during the scroll of the ten lines was evaluated by the current evaluation systems A to H and, when this electric current value exceeded 1.3 A, the switching boxes A to H were controlled to stop the application of a voltage to the corresponding upper wirings. This step was repeated three times and all the devices were activated.

<Second Activation Step>

Thereafter, after evacuating the inside of the vacuum container 212 to $10^{-5}$ Pa, methane (molecular weight: 16) was introduced in the vacuum container 212 up to $1\times10^{-1}$ Pa in a partial pressure. As in the first activation step, a voltage was applied to ten lines in time division and a voltage was applied to the part between the device electrodes 2 and 3 of the corresponding electroconductive film 204 to perform the second activation step. A waveform of the applied voltage in the second activation step was the same as in the first activation step, and activation time was uniformly thirty minutes. A device current flowing to the upper wirings at the end of the second activation step was in the range of 0.6 A to 0.8 A.

The electron source substrate 210 for which the above steps were finished was aligned with a face plate, on which a glass frame and phosphors were arranged, and sealed using a low melting point glass to fabricate a vacuum envelope. Moreover, as in the second embodiment, the steps of baking, sealing and the like were applied in the state in which the foregoing envelope was evacuated to be vacuum to fabricate the image-forming apparatus shown in FIG. 6. When dispersion of an electron-emitting characteristic (If and Ie) of each electron-emitting device in the obtained image-forming apparatus was measured, it was 9% in If and 10% in Ie.

As described in the above embodiments, in an activation step of an electron-emitting device, in particular, an activation step for simultaneously treating a plurality of electron-emitting devices, deposits containing carbon can be deposited in short time in an electron-emitting region and in its vicinity and, at the same time, decrease in uniformity of an electron-emitting characteristic due to distribution and fluctuation of an organic material gas concentration in an atmosphere can be prevented by an activation step of a first stage in the atmosphere containing an organic material of a high molecular weight (in particular, preferably an organic material with a molecular weight of 100 or more). Moreover, a plurality of activation steps are provided. Optimization of the electron-emitting characteristic is advanced and the electron-emitting characteristic of each device in a lot or between lots can be uniform and stabilized by an activation step of a second stage in an atmosphere containing an organic material of a low molecule weight (in particular, preferably an organic material with a molecular weight of less than 100).

Consequently, a high-grade image-forming apparatus with little unevenness of luminance and high stability can be provided with good reproducibility. Moreover, in the activation step, since it becomes possible to simultaneously fabricate a plurality of electron-emitting devices without decreasing uniformity of the electron-emitting characteristic, it can be expected that production costs are decreased by reduction of a tact time of steps.

As described above, according to the present invention, a method of fabricating an electron-emitting device and an electron source can be provided which is capable of performing an activation step in shorter time.

In addition, according to the present invention, a method of fabricating an electron-emitting device and an electron source can be provided which is capable of forming a film of carbon or carbon compound excellent in crystallinity during an activation step in shorter time.

In addition, according to the present invention, a method of fabricating an electron source can be provided which is capable of performing an activation step in shorter time even in a method of fabricating an electron source provided with a plurality of electron-emitting devices.

In addition, according to the present invention, a method of fabricating an electron source can be provided which is capable of fabricating an electron source provided with an electron-emitting device excellent in uniformity in an activation step in shorter time even in the method of fabricating an electron source provided with a plurality of electron-emitting devices.

Further, according to the present invention, a method of fabricating an image-forming apparatus can be provided which is capable of obtaining an image-forming apparatus that can realize a uniform luminance characteristic.

What is claimed is:

1. A method of forming a deposit of carbon or a carbon compound on a precursory structure which becomes an electron-emitting region in an electron-emitting device made on a substrate, the method comprising:

a first step for depositing carbon or a carbon compound in a gas atmosphere which includes a carbon compound of a first molecular weight; and subsequently a second step for depositing carbon or a carbon compound in a gas atmosphere which includes a carbon compound of a second molecular weight smaller than the first molecular weight, wherein the first step is performed in an atmosphere of a carbon compound gas with a molecular weight of 100 or more and the second step is performed in an atmosphere of a carbon compound gas with a molecular weight of less than 100.

2. A method of fabricating an electron-emitting device, comprising a forming step for forming a pair of conductive members which are arranged with a gap and an activation step for depositing carbon or a carbon compound on at least one of the conductive members in the pair, wherein said activation step includes at least first and second steps:

in the first step the carbon or carbon compound is deposited in a gas atmosphere which includes a carbon compound of a first molecular weight; and in the second step taken succeeding the first step, the carbon or carbon compound is deposited in a gas atmosphere which includes a carbon compound of a second molecular weight smaller than the first molecular weight, wherein the first step is performed in an atmosphere of a carbon compound gas with a molecular weight of 100 or more and the second step is performed in an atmosphere of a carbon compound gas with a molecular weight of less than 100.

3. A method of forming a deposit of carbon or a carbon compound on a precursory structure which becomes an electron-emitting region in an electron-emitting device made on a substrate, the method comprising:

a first step for depositing carbon or a carbon compound in a gas atmosphere which includes a carbon compound of a first molecular weight; and subsequently a second step for depositing carbon or a carbon compound in a gas atmosphere which includes a carbon compound of a second molecular weight smaller than the first molecular weight, wherein a carbon compound gas in the gas atmosphere in the first step is one selected from the group consisting of tolunitrile and benzonitrile.

4. A method of fabricating an electron-emitting device, comprising a forming step for forming a pair of conductive members which are arranged with a gap and an activation step for depositing carbon or a carbon compound on at least one of the conductive members in the pair, wherein said activation step includes at least first and second steps:

in the first step the carbon or carbon compound is deposited in a gas atmosphere which includes a carbon compound of a first molecular weight; and in the second step taken succeeding the first step, the carbon or carbon compound is deposited in a gas atmosphere which includes a carbon compound of a second molecular weight smaller than the first molecular weight, wherein a carbon compound gas in the gas atmosphere in the first step is one selected from the group consisting of tolunitrile and benzonitrile.

5. A method of forming a deposit of carbon or a carbon compound on a precursory structure which becomes an electron-emitting region in an electron-emitting device made on a substrate, the method comprising:

a first step for depositing carbon or a carbon compound in a gas atmosphere which includes a carbon compound of a first molecular weight; and subsequently a second step for depositing carbon or a carbon compound in a gas atmosphere which includes a carbon compound of a second molecular weight smaller than the first molecular weight, wherein the first step and the second step are performed in an atmosphere of a carbon compound gas, the carbon compound gas in the first step is one selected from the group consisting of tolunitrile and benzonitrile and the carbon compound gas in the second step is one selected from the group consisting of methane, ethane, propane, ethylene, propylene and acetylene.

6. A method of fabricating an electron-emitting device, comprising a forming step for forming a pair of conductive members which are arranged with a gap and an activation step for depositing carbon or a carbon compound on at least one of the conductive members in the pair, wherein said activation step includes at least first and second steps:

in the first step the carbon or carbon compound is deposited in a gas atmosphere which includes a carbon compound of a first molecular weight; and in the second step taken succeeding the first step, the carbon or carbon compound is deposited in a gas atmosphere which includes a carbon compound of a second molecular weight smaller than the first molecular weight, wherein the first step and the second step are performed in an atmosphere of a carbon compound gas, the carbon compound gas in the first step is one selected from the group consisting of tolunitrile and benzonitrile and the carbon compound gas in the second step is one selected from the group consisting of methane, ethane, propane, ethylene, propylene and acetylene.

7. The method according to claim 1 or 2, wherein the first step and the second step are performed in an atmosphere of a carbon compound gas, the carbon compound gas in the first step is one selected from the group consisting of tolunitrile and benzonitrile and the carbon compound gas in the second step is one selected from the group consisting of methane, ethane, propane, ethylene, propylene and acetylene.

8. The method according to any one of claims 1–6, wherein the second step is performed in an atmosphere of a carbon compound gas, and a hydrogen gas is mixed in the carbon compound gas in the second step.

9. A method of fabricating an electron source provided with a plurality of electron-emitting devices and wirings connected to said plurality of electron-emitting devices on a substrate, wherein said plurality of electron-emitting devices are each fabricated by a method according to claim 1 or 2.

10. A method of fabricating an image-forming apparatus including an electron source and an image-forming member, wherein said electron source is fabricated by a method according to claim 9.

11. The method according to any one of claims 1–6, wherein the second step is conducted as a final step in deposit forming.

* * * * *

UNITED STATES PATENT AND TRADEMARK OFFICE

CERTIFICATE OF CORRECTION

PATENT NO. : 6,755,709 B2
APPLICATION NO. : 10/152828
DATED : June 29, 2004
INVENTOR(S) : Kazuhiro Jindai et al.

It is certified that error appears in the above-identified patent and that said Letters Patent is hereby corrected as shown below:

ON TITLE PAGE AT (30) FOREIGN APPLICATION PRIORITY DATA

"2001/156732" should read --2001-156732-- and "2002/140959" should read --2002-40959--.

COLUMN 24

Line 15, "35020C." should read --350 °C--.

Signed and Sealed this

Twenty-sixth Day of June, 2007

JON W. DUDAS
*Director of the United States Patent and Trademark Office*